US008052260B2

(12) United States Patent
Hattori

(10) Patent No.: US 8,052,260 B2
(45) Date of Patent: Nov. 8, 2011

(54) INK CARTRIDGES AND INK SUPPLY SYSTEMS

(75) Inventor: Shingo Hattori, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 457 days.

(21) Appl. No.: 12/325,992

(22) Filed: Dec. 1, 2008

(65) Prior Publication Data

US 2009/0079805 A1 Mar. 26, 2009

Related U.S. Application Data

(63) Continuation-in-part of application No. 12/140,227, filed on Jun. 16, 2008.

(30) Foreign Application Priority Data

| | | |
|---|---|---|
| Jan. 30, 2007 | (JP) | 2007-018806 |
| Mar. 28, 2007 | (JP) | 2007-083778 |
| Mar. 30, 2007 | (JP) | 2007-094759 |
| Nov. 30, 2007 | (JP) | 2007-311815 |

(51) Int. Cl.
*B41J 2/175* (2006.01)

(52) U.S. Cl. ..... 347/86

(58) Field of Classification Search ..... 347/86, 347/7, 19

See application file for complete search history.

(56) References Cited

U.S. PATENT DOCUMENTS

| | | | | |
|---|---|---|---|---|
| 4,350,909 | A * | 9/1982 | Yamada | 310/62 |
| 4,716,290 | A * | 12/1987 | Ogawa | 250/231.18 |
| 4,716,291 | A * | 12/1987 | Sakamoto et al. | 250/318 |
| 2005/0195225 | A1 | 9/2005 | Takagi et al. | |

FOREIGN PATENT DOCUMENTS

JP 2005-254734 A 9/2005

* cited by examiner

*Primary Examiner* — Huan Tran
(74) *Attorney, Agent, or Firm* — Baker Botts L.L.P.

(57) ABSTRACT

An ink cartridge has a case which has an ink chamber, a first wall facing an exterior of the case, and a translucent portion at the first wall and having an inner space formed therein continuously with the ink chamber. The ink cartridge has a first movable member positioned in the case, and a second movable member coupled to the case. The first movable member moves relative to an amount of ink stored in the ink chamber, and has a signal blocking portion positioned in the inner space. The second movable member has a second wall that faces the first wall and that has an opening therethrough. The second movable member moves between a first position and a second position. The second wall is closer to the first wall when the second movable member is in the second position than when the second movable member is in the first position.

10 Claims, 11 Drawing Sheets

INK CARTRIDGES AND INK SUPPLY SYSTEMS

CROSS-REFERENCE TO RELATED APPLICATION

The present application is a continuation in part application of U.S. patent application Ser. No. 12/140,227 ("the '227 application"), which was filed on Jun. 16, 2008, and claims priority from Japanese Patent Application No. JP-2007-311815, which was filed on Nov. 30, 2007, and the '227 application, the disclosures of which are incorporated herein by reference in their entirety.

BACKGROUND OF THE INVENTION

1. Field of the Invention

The present invention relates to ink cartridges and ink supply systems.

2. Description of Related Art

A known inkjet printer, such as the inkjet printer described in JP-A-2005-254734, has a known ink supply system. The known ink supply system has a known ink cartridge having an ink chamber, and a known cartridge mounting portion configured to removably receive the ink cartridge. When the ink cartridge is mounted to the cartridge mounting portion, an ink path is formed extending from the ink chamber to a recording head of the inkjet printer. Ink is supplied from the ink chamber to the recording head via the ink path. The recording head is configured to selectively eject ink toward a sheet of paper, such that an image is formed on the sheet of paper.

The known ink cartridge has a detection portion, and the amount of ink stored in the ink chamber is detected via the detection portion. The detection portion is positioned corresponding to a detector such as an optical sensor positioned in the cartridge mounting portion when the ink cartridge is mounted to the cartridge mounting portion. During the mounting of the ink cartridge to the cartridge mounting portion, the detection portion needs to be positioned in a correct position in relation to the detector for the amount of ink to be detected accurately.

The known ink cartridge also has an ink supply portion through which ink is supplied from the interior of the ink chamber to the exterior of the ink chamber, and the cartridge mounting portion has a connecting portion configured to be connected to the ink supply portion when the ink cartridge is mounted to the cartridge mounting portion. Ink is supplied from the ink chamber to the recording head via the ink supply portion and the connecting portion. During the mounting of the ink cartridge to the cartridge mounting portion, the ink supply portion needs to be positioned in a correct position in relation to the connecting portion for the ink supply portion to be connected to the connecting portion accurately.

The known cartridge mounting portion has a guide surface extending in a direction in which the ink cartridge is inserted into the cartridge mounting portion. Nevertheless, the positioning of the detection portion and the ink supply portion in relation to the detector and the connecting portion may not be accurate. For example, when the inner dimensions of the cartridge mounting portion or the outer dimensions of a case of the ink cartridge vary due to dimension errors, the detection portion or the ink supply portion may not be positioned in a correct position in relation to the detector or the connecting portion. When the ink cartridge is assembled from a plurality of members, the variations of the outer dimensions of the case may increase, and this incorrect positioning may occur frequently.

When the detection portion or the ink supply portion is not positioned in a correct position in relation to the detector or the connecting portion accurately, the detection portion or the ink supply portion may break, or the detector or the connecting portion may break because these elements may collide with each other.

SUMMARY OF THE INVENTION

Therefore, a need has arisen for ink cartridges and ink supply systems which overcome these and other shortcomings of the related art. A technical advantage of the present invention is that an element of an ink cartridge is positioned in a correct position in relation to an element of a cartridge mounting portion.

In an embodiment of the invention, an ink cartridge comprises a case comprising an ink chamber configured to store ink therein, a first wall facing an exterior of the case, and a translucent portion positioned at the first wall and having an inner space formed therein, wherein the inner space is continuous with the ink chamber. The case also comprises a first movable member positioned in the case, and configured to move relative to an amount of ink stored in the ink chamber, wherein the first movable member comprises a particular signal blocking portion positioned in the inner space, and a second movable member coupled to the case, wherein the second movable member comprises a second wall facing the first wall, wherein the second wall has an opening formed therethrough, and the second movable member is configured to move between a first position and a second position, and the second wall is positioned closer to the first wall when the second movable member is in the second position than when the second movable member is in the first position.

In another embodiment of the invention, an ink cartridge comprises a case comprising an ink chamber configured to store ink therein, and a first wall facing an exterior of the case. The ink cartridge also comprises an ink supply portion positioned at the first wall, and configured to supply ink from an interior of the ink chamber to an exterior of the ink chamber, and a particular movable member coupled to the case, wherein the particular movable member comprises a second wall facing the first wall, and the second wall has an opening formed therethrough, and wherein the particular movable member is configured to move between a first position and a second position, and the second wall is positioned closer to the first wall when the particular movable member is in the second position than when the particular movable member is in the first position.

In yet another embodiment of the invention, an ink supply system comprises a cartridge mounting portion comprising a protrusion, and an ink cartridge configured to be removably mounted to the cartridge mounting portion. The ink cartridge comprises a case comprising an ink chamber configured to store ink therein, a first wall facing an exterior of the case, and a translucent portion positioned at the first wall and having an inner space formed therein, wherein the inner space is continuous with the ink chamber. The ink cartridge also comprises a first movable member positioned in the case, and configured to move relative to an amount of ink stored in the ink chamber, wherein the first movable member comprises a particular signal blocking portion positioned in the inner space, and a second movable member coupled to the case and comprising a second wall facing the first wall, wherein the second wall has a particular opening formed therethrough at a position at which an edge of the particular opening contacts an outer peripheral surface of the projection during a mounting of the ink cartridge to the cartridge mounting portion, and wherein the second movable member is configured to move between a first position and a second position, and the second wall is positioned closer to the first wall when the second movable member is in the second position than when the second movable member is in the first position.

In still another embodiment of the invention, an ink supply system comprises a cartridge mounting portion comprising a protrusion, and an ink cartridge configured to be removably mounted to the cartridge mounting portion. The ink cartridge comprises a case comprising an ink chamber configured to store ink therein, and a first wall facing an exterior of the case. The ink cartridge also comprises an ink supply portion positioned at the first wall, and configured to supply ink from an interior of the ink chamber to an exterior of the ink chamber, and a particular movable member coupled to the case, wherein the particular movable member comprises a second wall facing the first wall, wherein the second wall has a particular opening formed therethrough, at a position at which an edge of the particular opening contacts an outer peripheral surface of the projection during a mounting of the ink cartridge to the cartridge mounting portion, and wherein the particular movable member is configured to move between a first position and a second position, and the second wall is positioned closer to the first wall when the particular movable member is in the second position than when the particular movable member is in the first position.

Other objects, features, and advantages of embodiments of the present invention will be apparent to persons of ordinary skill in the art from the following description of preferred embodiments with reference to the accompanying drawings.

BRIEF DESCRIPTION OF DRAWINGS

For a more complete understanding of the present invention, the needs satisfied thereby, and the objects, features, and advantages thereof, reference now is made to the following description taken in connection with the accompanying drawings.

DETAILED DESCRIPTION OF EMBODIMENTS

Embodiments of the invention and their features and technical advantages may be understood by referring to FIGS. 1-11, like numerals being used for like corresponding portions in the various drawings.

Figure 6:
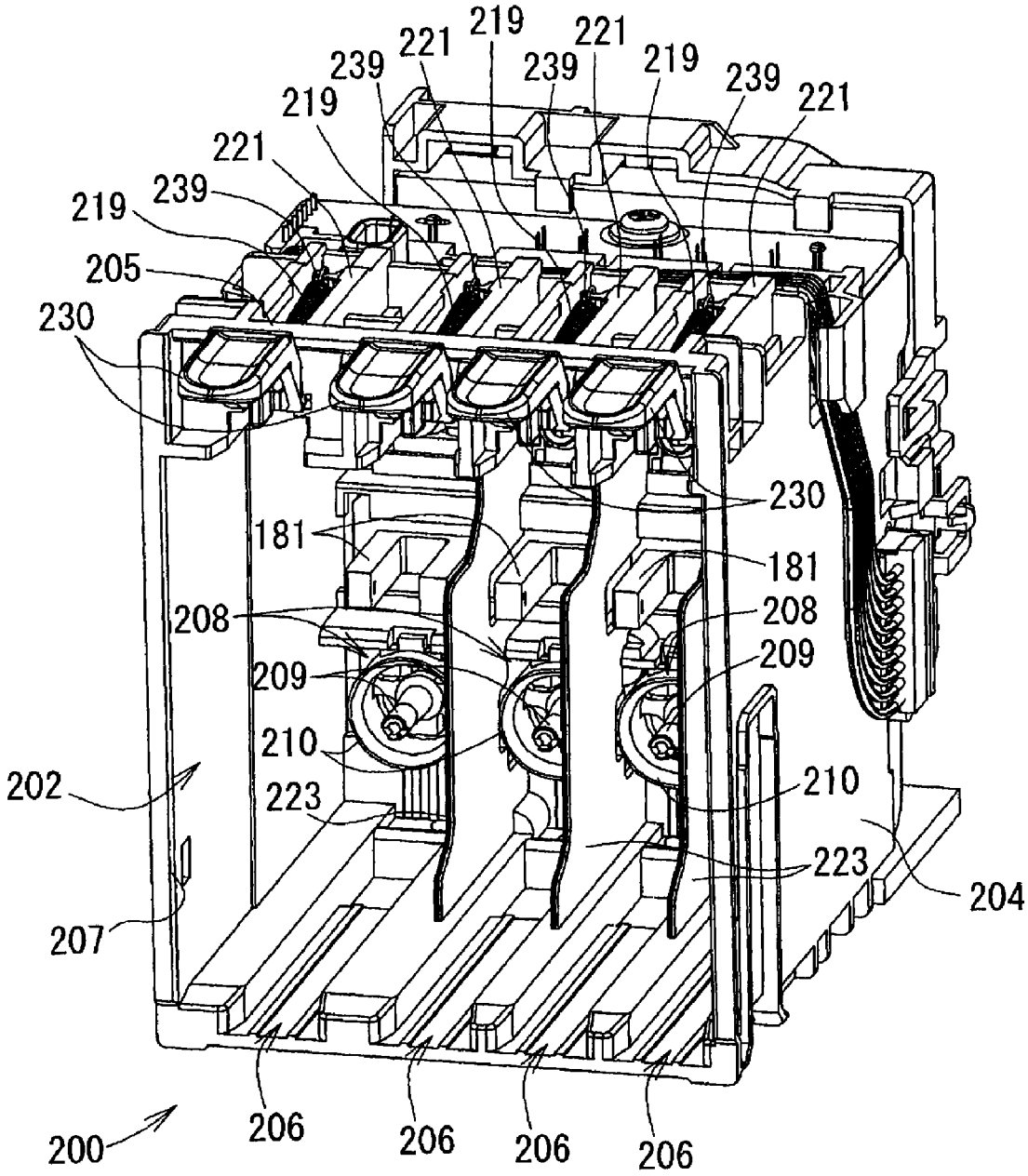
FIG. 6 is a perspective view of a cartridge mounting portion according to an embodiment of the invention.
Figure 7:
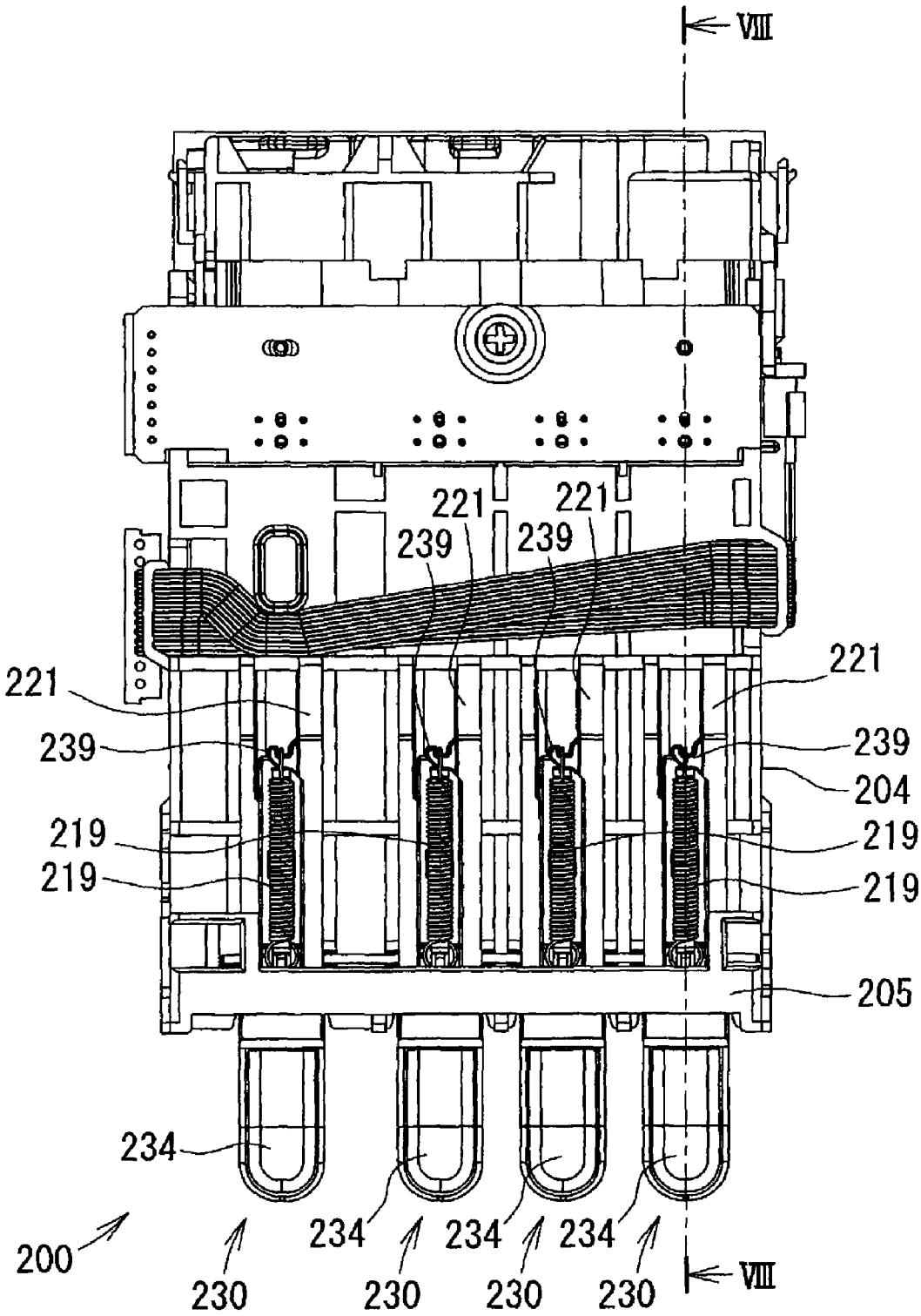
FIG. 7 is a plan view of the cartridge mounting portion of FIG. 6.

FIGS. 1 and 6 show an ink cartridge 100 which may be used in an image forming apparatus, such as an inkjet printer (not shown), according to an embodiment of the invention. The image forming apparatus may comprise an ink supply system comprising at least one ink cartridge 100, e.g., four ink cartridges 100, and a cartridge mounting portion 200 configured to removably receive four ink cartridges 100. The ink supply system may be configured to supply ink stored in ink cartridges 100 to a recording head of the image forming apparatus.

Referring to FIGS. 1(A) to 2(B), ink cartridge 100 may have a substantially rectangular, parallelepiped shape having a width in a width direction 31, a height in a height direction 32, and a depth in a depth direction 33. The width may be less than each of the height and the depth. Ink cartridge 100 may be configured to be inserted into cartridge mounting portion 200 in an insertion direction 30, which may be parallel to depth direction 33. When ink cartridge 100 is mounted to cartridge mounting portion 200, a surface of ink cartridge 100 positioned at the top of ink cartridge 100 in FIGS. 1(A) to 2(B) may be positioned at the top of ink cartridge 100, and a surface of ink cartridge 100 positioned at the bottom of the ink cartridge 100 in FIGS. 1(A) to 2(B) may be positioned at the bottom of ink cartridge 100.

Figure 1B:
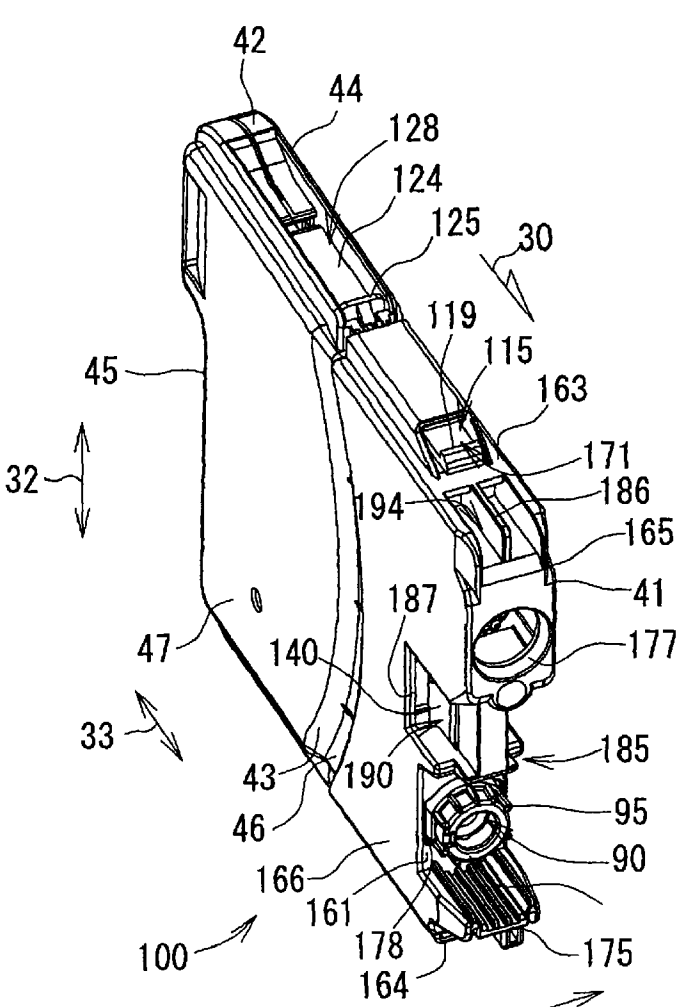
FIG. 1(B) is a perspective view of the ink cartridge in which the slider is in a second position.
Figure 1A:
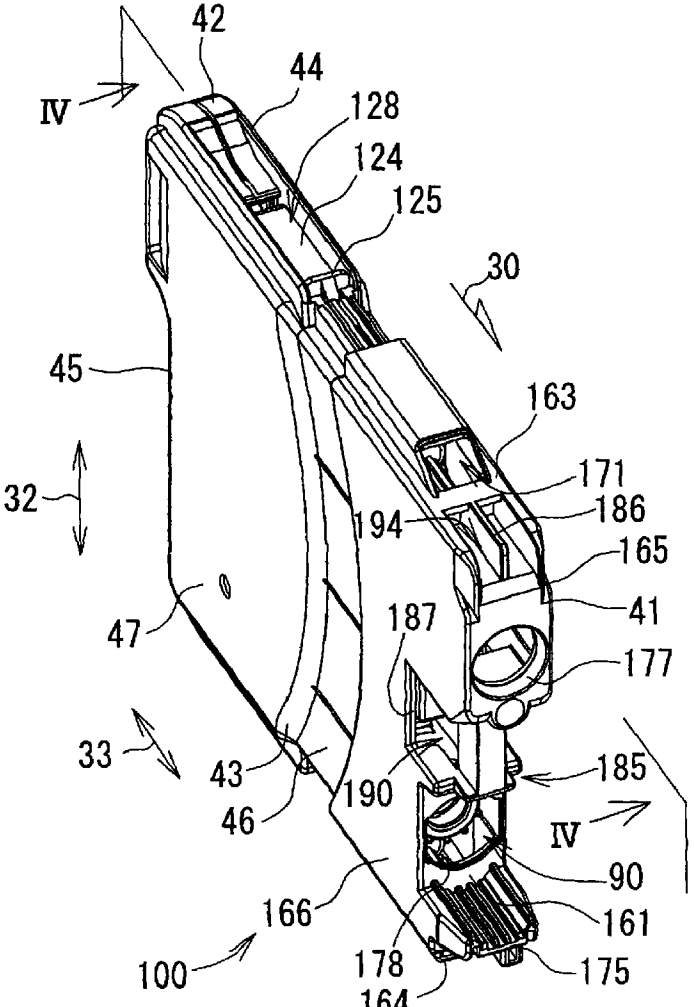
FIG. 1(A) is a perspective view of an ink cartridge according to an embodiment of the invention, in which a slider of the ink cartridge is in a first position.
Figure 2A:
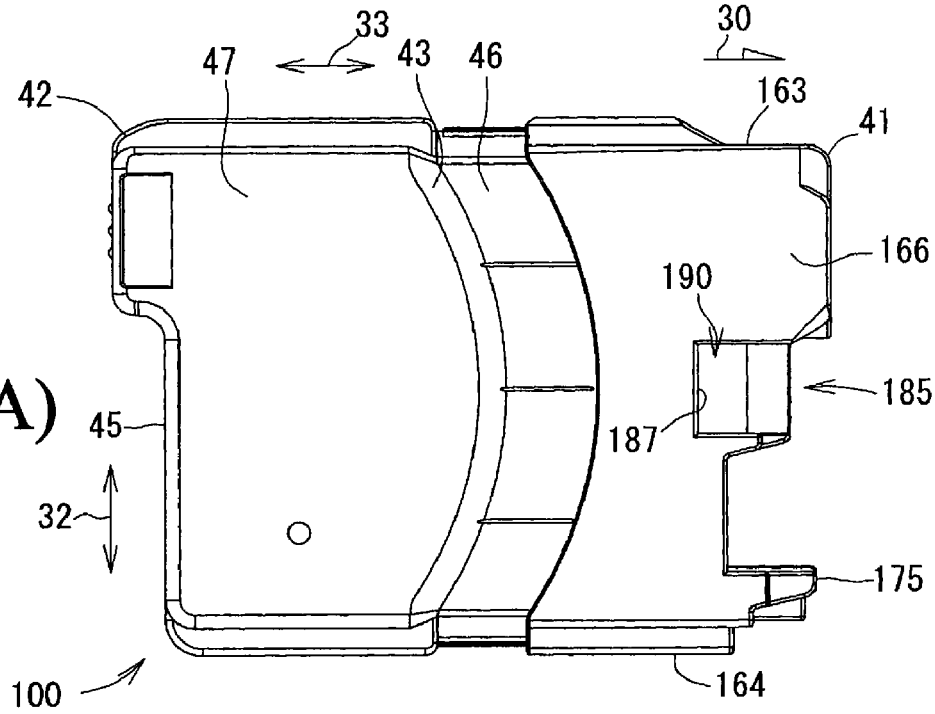
FIG. 2(A) is a side view of the ink cartridge of FIG. 1(A).
Figure 2B:
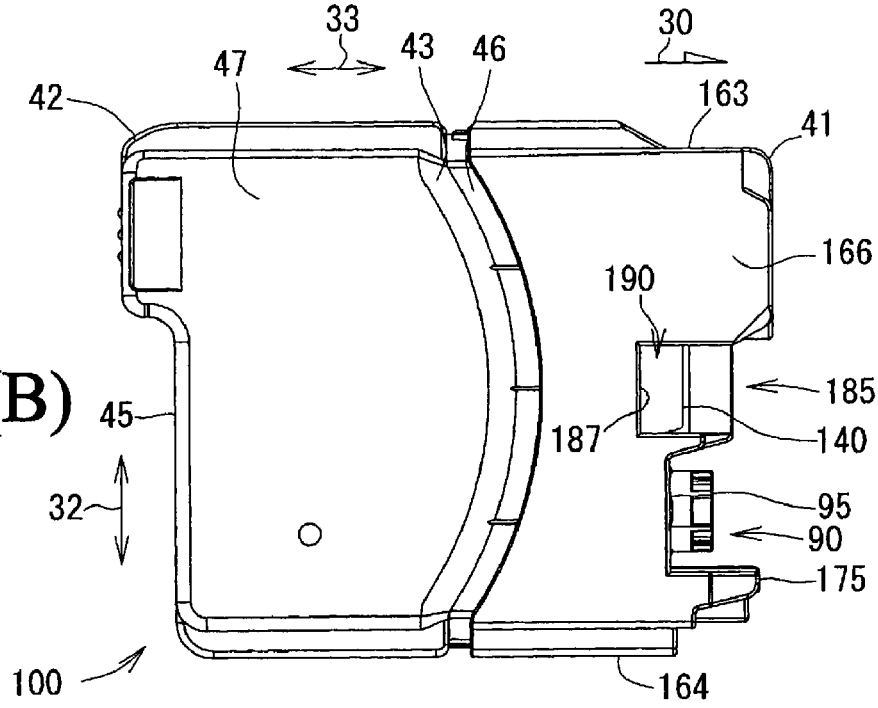
FIG. 2(B) is a side view of the ink cartridge of FIG. 1(B).
Figure 3B:
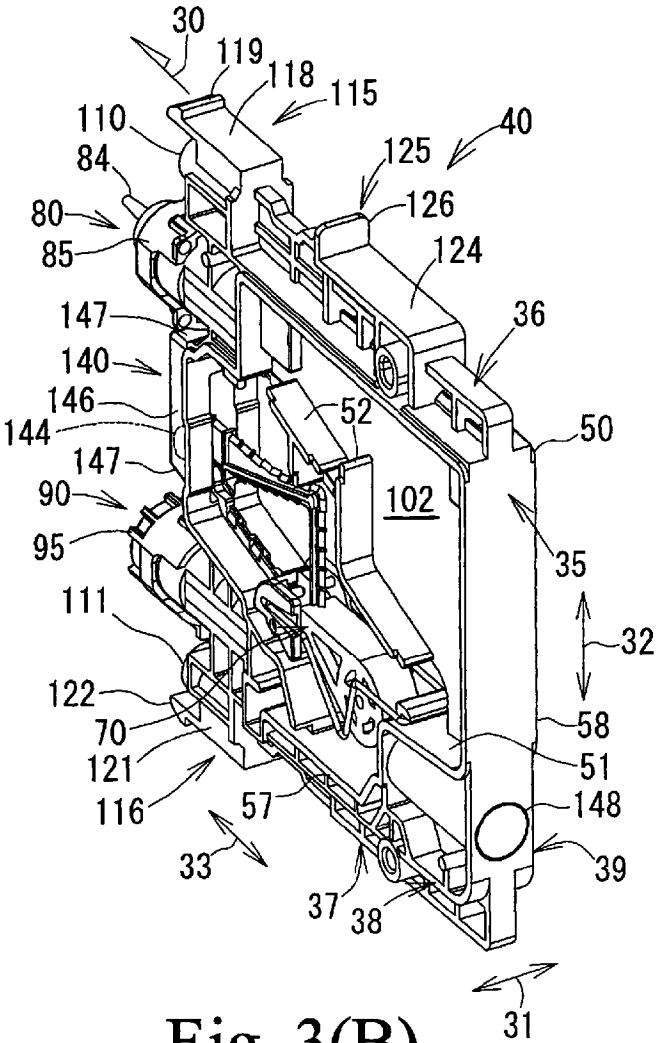
FIG. 3(B) is a rear perspective view of the case of FIG. 3(A).
Figure 3A:
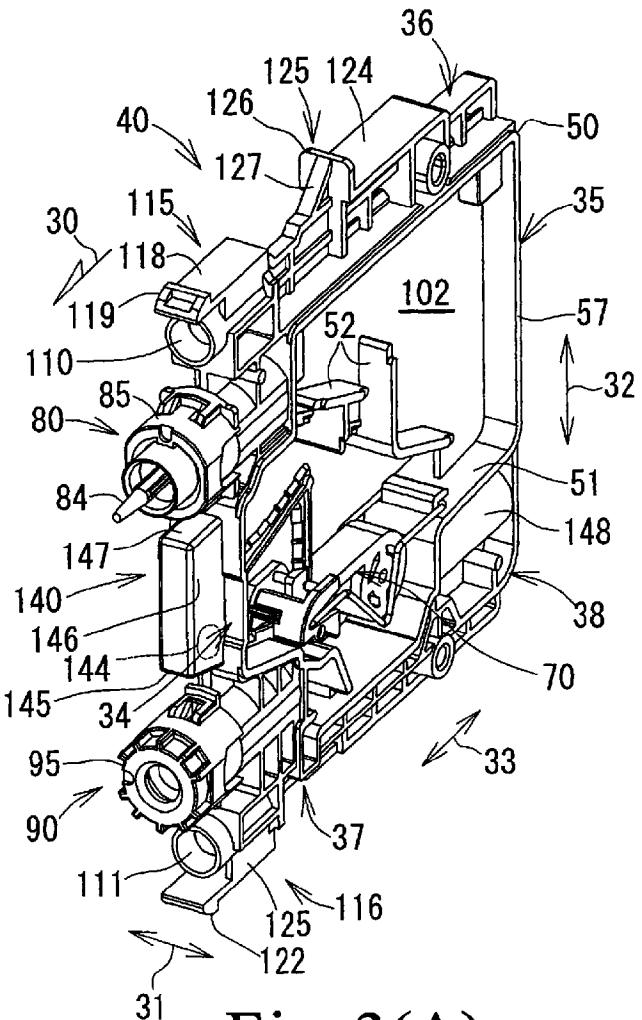
FIG. 3(A) is a front perspective view of a case of the ink cartridge of FIGS. 1(A) and 1(B).
Figure 4:
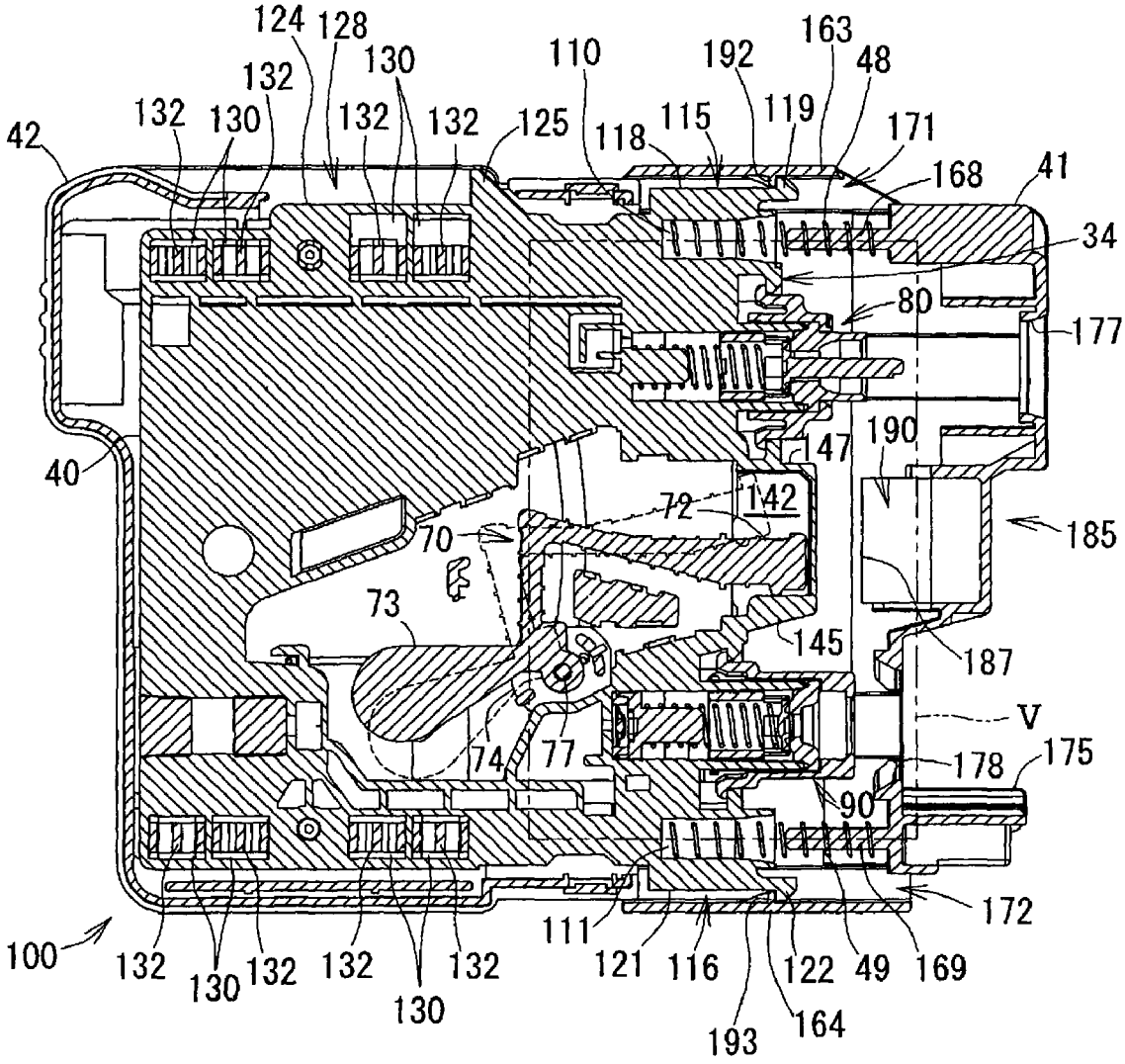
FIG. 4 is a cross-sectional view of the ink cartridge taken along line IV-IV in FIG. 1(A).

Ink cartridge 100 may comprise a case 40 as shown in FIGS. 3(A) and 3(B), a movable member, e.g., a slider 41, and a case cover 42, as shown in FIGS. 1(A) to 2(B), and at least one resilient member, e.g., coil springs 48 and 49, as shown in FIG. 4. Slider 41 and case cover 42 may substantially define the outer appearance of ink cartridge 100. Slider 41 and case cover 42 may substantially enclose case 40. Each of case 40, slider 41, and case cover 42 may comprise a resin material, e.g., nylon, polyethylene, polypropylene, or the like.

Referring to FIGS. 3(A) and 3(B), case 40 may have a substantially rectangular, parallelepiped shape, and may comprise a front wall 34, a rear wall 35 opposite front wall 34, a top wall 36 extending between front wall 34 and rear wall 35, a bottom wall 37 extending between front wall 34 and rear wall 35 and positioned opposite top wall 36, a left wall 38 extending between front wall 34 and rear wall 35, and a right wall 39 extending between front wall 34 and rear wall 35 and positioned opposite left wall 38. Each of front wall 34, rear wall 35, top wall 36, bottom wall 37, left wall 38, and right wall 39 may face the exterior of case 40, and may define the outer appearance of case 40. When ink cartridge 100 is inserted into cartridge mounting portion 200, case 40 may be inserted from a front wall 34 side.

When ink cartridge 100 is mounted to cartridge mounting portion 200, top wall 36 may be positioned at the top of case 40, and bottom wall 37 may be positioned at the bottom of case 40. Each of an area of left wall 38 and an area of right wall 39 may be greater than an area of front wall 34, an area of rear wall 35, an area of top wall 36, and an area of bottom wall 37. Referring to FIGS. 2(A) to 3(B), case cover 42 may cover case 40 substantially in its entirety, except for front wall 34 and a portion of top wall 36. As such, most portions of case 40, including side walls 38 and 39, may be protected from damage when an external force is applied to ink cartridge 100.

Referring to FIG. 4, slider 41 may be coupled to case 40 via coil springs 48 and 49. Referring to FIGS. 2(A) to 3(B), slider 41 may cover front wall 34 of case 40 and a front portion 46 of case cover 42, which may be positioned adjacent to front wall 34 of case 40. Slider 41 may be configured to slide in depth direction 33. In FIGS. 1(A) and 2(A), slider 41 is in a first position along the sliding range in the depth direction 33, which corresponds to a position at which a front wall 161 of slider 41 is most distant from front wall 34 of case 40. In FIGS. 1(B) and 2(B), slider 41 is in a second position along the sliding range, which corresponds to a position at which front wall 161 of slider 41 is closest to front wall 34 of case 40.

Referring to FIGS. 3(A) and 3(B), case 40 may comprise a frame 50, a movable member, e.g., a pivotable member 70, air communication valve mechanism 80, ink supply valve mechanism 90, and a pair of flexible, translucent, e.g., transparent or semi-transparent, films (not shown) attached to frame 50. The pair of films is omitted in FIGS. 3(A) and 3(B). Frame 50 may comprise front wall 34, rear wall 35, top wall 36, and bottom wall 37. The pair of films may comprise left wall 38 and right wall 39. Frame 50 may comprise a translucent material, e.g., a transparent or semi-transparent resin material, e.g., polyacetal, nylon, polyethylene, and polypropylene, and may be manufactured by injection-molding the resin material.

Frame 50 may comprise an outer peripheral wall 51 and inner walls 52. Outer peripheral wall 51 and inner walls 52 may be integrally formed and may extend between left wall 38 and right wall 39. Outer peripheral wall 51 may have a substantially rectangular profile extending along front wall 34, top wall 36, rear wall 35, and bottom wall 37 to form a space therein. As such, openings 57 and 58 may be formed at widthwise ends of frame 50, respectively. Inner walls 52 may be positioned inside outer peripheral wall 51.

The pair of films may be attached, e.g., welded or bonded with adhesive, to widthwise ends of outer peripheral wall 51, respectively, such that openings 57 and 58 may be covered by the pair of films, respectively. Outer peripheral wall 51 and the pair of films may define an ink chamber 102 therein, and ink chamber 102 may be configured to store ink therein. In another embodiment, the frame may be a container having rigid six faces, and an ink chamber may be formed in the container.

The pair of films also may be attached, e.g., welded or bonded with adhesive, to widthwise ends of inner walls 52, respectively. Because the pair of films is supported by inner walls 52, slack, e.g., looseness, of the pair of films may be prevented. When an external force is applied to ink cartridge 100, such that slider 41 and case cover 42 are bent toward case 40, slider 41 and case 42 may be supported by inner walls 52, and therefore, deformation of slider 41 and case 42 may be prevented.

Frame 50 may comprise an ink introduction portion 148 positioned at rear wall 35. Ink introduction portion 148 may comprise a substantially circular, cylindrical chamber extending from rear wall 35 toward ink chamber 102. The cylindrical chamber of ink introduction portion 148 may be configured to be in fluid communication with ink chamber 102. When ink cartridge 100 is manufactured, ink may be introduced into ink chamber 102 via ink introduction portion 148, such that ink chamber 102 is filled with ink. The cylindrical chamber of ink introduction portion 148 may be plugged by a material, e.g., rubber.

Frame 50 may comprise a translucent portion 140 positioned at front wall 34. The amount of ink stored in ink chamber 102 may be observed or detected visually or optically via translucent portion 140. Translucent portion 140 may be integral with frame 50. Therefore, translucent portion 140 may comprise the same material as frame 50, e.g., a translucent material, e.g., a transparent or semi-transparent resin material. Light may pass through translucent portion 140.

Referring to FIGS. 3(A) to 4, translucent portion 140 may be positioned between air communication valve mechanism 80 and ink supply valve mechanism 90, and may extend outward from front wall 34 of case 40. Translucent portion 140 may have a substantially rectangular, parallelepiped shape, and may comprise five rectangular walls. Translucent portion 140 may have an inner space 142, which may be continuous with ink chamber 102, and may be defined by the five rectangular walls of translucent portion 140.

When ink cartridge 100 is mounted to cartridge mounting portion 200, translucent portion 140 may be positioned in an optical path 183 of an optical sensor 181, e.g., a photo-interrupter, of cartridge mounting portion 200. Translucent portion 140 may comprise an irradiation portion 144 positioned at one of side walls 146 of translucent portion 140, which may extend in height direction 32, and optical path 183 may intersect irradiation portion 144.

Referring to FIGS. 3(A) to 4, pivotable member 70 may be positioned in ink chamber 102. Pivotable member 70 may comprise a shaft 77 extending in width direction 31, and shaft 77 may be supported by a rib 74 which may extend from outer peripheral wall 51 into ink chamber 102, such that pivotable member 70 pivots about shaft 77. Rib 74 may be positioned at the center of frame 50 in width direction 31.

Pivotable member 70 may comprise an opaque resin material. Pivotable member 70 may be manufactured by injection-molding resin material such as nylon, polyethylene, polypropylene, polycarbonate, polyolefin, or acryl resin, to which black pigment such as carbon black is added. At least a first signal blocking portion 72 of pivotable member 70 may be configured to block light, e.g., configured not to allow light to pass therethrough, or to not allow a portion of light to pass through. In another embodiment of the invention, the entirety of pivotable member 70 may be configured to block light, e.g., configured not to allow light, or a portion of light, to pass therethrough.

Pivotable member 70 may comprise a float portion 73 positioned at one end of pivotable member 70. The specific gravity of float portion 73 may be less than the specific gravity of ink stored in ink chamber 102. For example, float portion 73 may comprise a hollow body formed therein, such that the specific gravity of float portion 73 becomes less than the specific gravity of ink stored in ink chamber 102. Float portion 73 may be configured to float on ink and move up and down according to an increase or a decrease of the amount of ink in ink chamber 102. Pivotable member 70 may pivot in accordance with the movement of float portion 73.

Pivotable member 70 may comprise first signal blocking portion 72 positioned at another end of pivotable member 70, and first signal blocking portion 72 may be positioned in inner space 142. When float portion 73 moves up and down based on the amount of ink stored in ink chamber 102, pivotable member 70 may pivot, and first signal blocking portion 72 may move up and down within inner space 142 according to the movement of pivotable member 70.

When a predetermined amount of ink is stored in ink chamber 102, float portion 73 may attempt to move upward. Nevertheless, because first signal blocking portion 72 contacts a bottom wall 145 of translucent portion 140, the pivotal movement of pivotable member 70 may be restricted, and pivotable member 70 may remain in a third position in which first signal blocking portion 72 contacts bottom wall 145, as shown by the solid line in FIG. 4. When pivotable member 70 is in the third position, first signal blocking portion 72 may block light which has passed though irradiation portion 144.

When the amount of ink stored in ink chamber 102 becomes less than a predetermined amount, float portion 73 may move downward in accordance with the fall of the surface of ink. First signal blocking portion 72 may move upward in space 142 in association with the downward movement of float portion 73. When first signal blocking portion 72 contacts a top wall 147 of translucent portion 140, pivotable member 70 may remain in a fourth position in which first signal blocking portion 72 contacts top wall 147, as shown by the dotted line in FIG. 4. When pivotable member 70 is in the fourth position, first signal blocking portion 72 may not block light which has passed though irradiation portion 144. Therefore, it may be determined whether ink chamber 102 has a predetermined, e.g., a sufficient, amount of ink therein by detecting whether light emitted from optical sensor 181 of cartridge mounting portion 200 is blocked.

Figure 5:
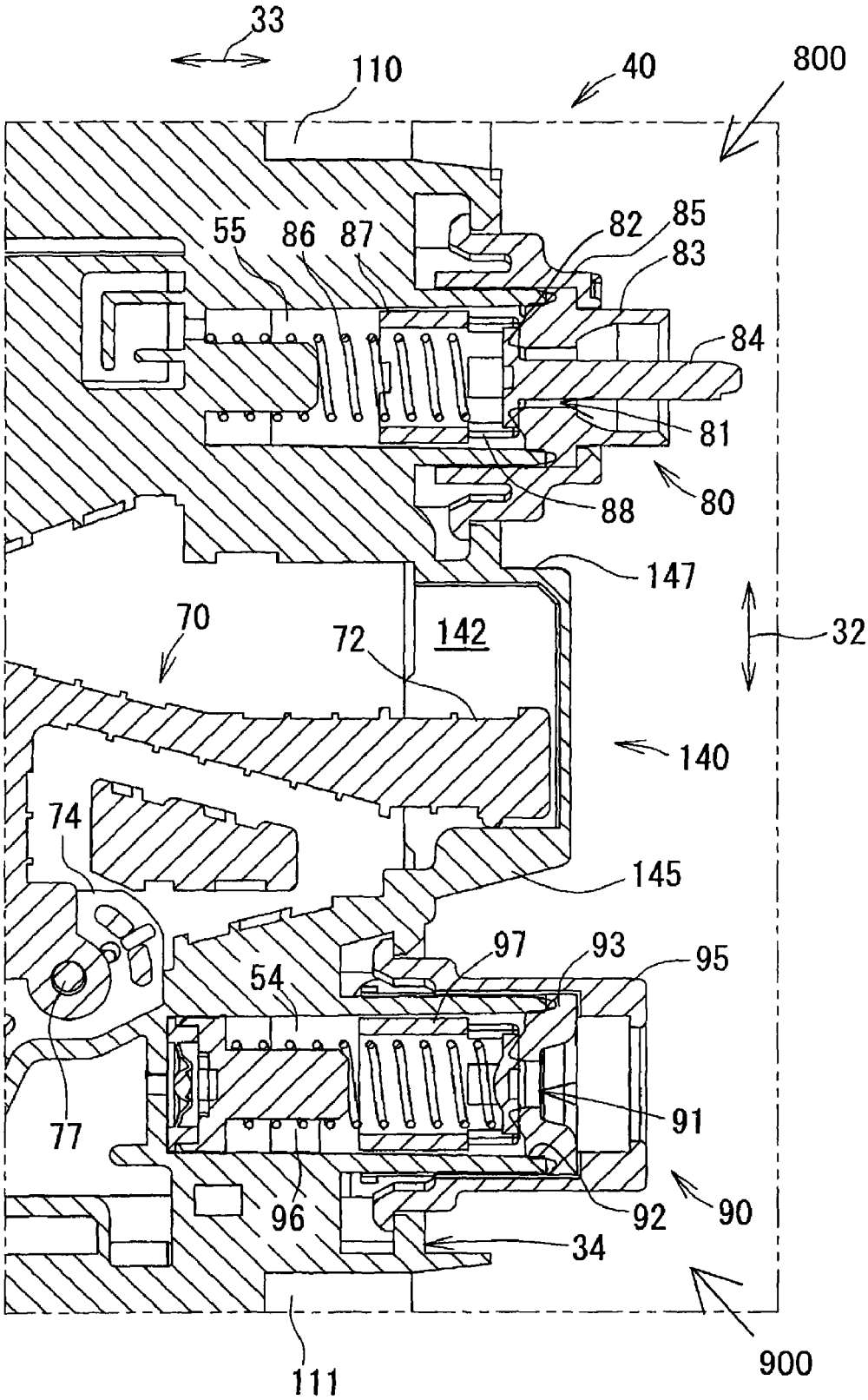
FIG. 5 is an enlarged, cross-sectional view of the dashed line area V of FIG. 4, depicting a front portion of the ink cartridge.

Referring to FIG. 5, ink cartridge 100 may comprise an air communication portion 800 positioned at front wall 34. Air communication portion 800 may comprise a substantially circular, cylindrical wall extending from a portion of front wall 34 toward the exterior of case 40 in depth direction 33. The portion of front wall 34 from which the cylindrical wall of air communication portion 800 extends may be positioned between top wall 36 and translucent portion 140. A circular opening 82 may be formed at an end of the cylindrical wall. A valve chamber 55 may be formed in the cylindrical wall, and valve chamber 55 may extend from opening 82 in depth direction 33, via the interior of the cylindrical wall to the interior of case 40 beyond front wall 34. Valve chamber 55 may be in fluid communication with ink chamber 102. Air communication portion 800 also may comprise air communication valve mechanism 80, and at least a portion of air communication valve mechanism 80 may be accommodated in valve chamber 55.

Air communication valve mechanism 80 may be configured to selectively allow and prevent fluid communication between the interior of ink chamber 102 and the exterior of case 40 via opening 82 and valve chamber 55. Air communication valve mechanism 80 may comprise a coil spring 86, a valve member 87, a sealing member 83, and a cap 85. Sealing member 83 may be positioned at the end of the cylindrical wall defining opening 82. Cap 85 may be attached to the outer peripheral portion of the cylindrical wall, sandwiching sealing member 83 therebetween. Cap 85 and sealing member 83 may have openings formed therethrough in depth direction 33, respectively. The openings of cap 85 and sealing member 83 may form an air communication opening 81, and valve chamber 55 may be configured to be in fluid communication with the exterior of case 40 via air communication opening 81.

Valve element 87 may be positioned in valve chamber 55, and configured to slide in depth direction 33. Valve element 87 may comprise a lid member 88 and a rod 84 extending from lid member 88. Rod 84 may be inserted into the air communication opening 81. A diameter of rod 84 may be less than an diameter of air communication opening 81, such that rod 84 may move with respect to sealing member 83, without contacting sealing member 83. A gap may be formed between rod 84 and sealing member 83 at air communication opening 81, and air may pass through the gap. Rod 84 may extend through the center of opening 82 to the exterior of case 40 along a center line of lid member 88.

When valve element 87 slides in valve chamber 55 in depth direction 33, lid member 88 may move between a fifth position in which lid member 88 contacts sealing member 83 and covers air communication opening 81 and a sixth position in which lid member 88 is positioned away from sealing member 83 and uncovers, e.g., does not cover, air communication opening 81. When lid member 88 is in the fifth position, a path extending from valve chamber 55 via the gap to the exterior of ease 40 may be blocked. When lid member 88 is in the sixth position, the path may be opened.

Coil spring 86 may be positioned in valve chamber 55, and may be configured to expand and contract in depth direction 33. Coil spring 86 may contact and apply a biasing force to lid member 88 toward opening 81 in depth direction 33. Therefore, when no external force is applied to lid member 88 in depth direction 33, lid member 88 may be in the fifth position. When external force is applied to lid member 88 against the biasing force of coil spring 86, lid member 88 may move from the firth position to the sixth position. Air communication opening 81 thus may be uncovered, and a path extending from the interior of ink chamber 102 to the exterior of ease 40 may be opened. Air may pass though the path extending from the interior of ink chamber 102 to the exterior of case 40, such that the pressure in ink chamber 102 becomes equal to the atmospheric pressure.

Referring to FIG. 5, ink cartridge 100 may comprise an ink supply portion 900 positioned at front wall 34. Ink supply portion 900 may comprise a substantially circular, cylindrical wall extending from a portion of front wall 34 positioned between bottom wall 37 and translucent portion 140, toward the exterior of case 40 in depth direction 33. A circular opening 92 may be formed at an end of the cylindrical wall of ink supply portion 900. A valve chamber 54 may be formed in the cylindrical wall of ink supply portion 900, and valve chamber 54 may extend from opening 92 via the interior of the cylindrical wall of ink supply portion 900 to the interior of case 40 beyond front wall 34. Valve chamber 54 may extend in depth direction 33, and may be in fluid communication with ink chamber 102. Ink supply portion 900 also may comprise ink supply valve mechanism 90, and at least a portion of ink supply valve mechanism 90 may be accommodated in valve chamber 54.

Ink supply valve mechanism 90 may be configured to selectively allow and prevent fluid communication between the interior of ink chamber 102 and the exterior of case 40 via opening 92 and valve chamber 54. Ink supply valve mechanism 90 may comprise a valve element 97, a coil spring 96, a sealing member 93, and a cap 95. Sealing member 93 may be positioned at the end of the cylindrical wall defining opening 92. Cap 95 may be attached to the outer peripheral portion of the cylindrical wall of ink supply portion 900, and sealing member 93 may be positioned therebetween. Cap 95 and sealing member 93 each may have openings formed therethrough, in depth direction 33. The openings of cap 95 and sealing member 93 may form an ink supply opening 91, and valve chamber 54 may be configured to be in fluid communication with the exterior of case 20 via ink supply opening 91.

Valve element 97 may be positioned in valve chamber 54, and configured to slide in depth direction 57. When valve element 97 slides in valve chamber 54 in depth direction 57, valve element 97 may move between a seventh position, in which valve element 97 contacts sealing member 93 and covers ink supply opening 91, and a eighth position, in which valve element 97 is positioned away from sealing member 93 and uncovers, e.g., does not cover, ink supply opening 91. When valve element 97 is in the seventh position, a path extending from valve chamber 54 via ink supply opening 91 to the exterior of case 40 may be blocked. When valve element 97 is in the eighth position, the path may be opened.

Figure 9:
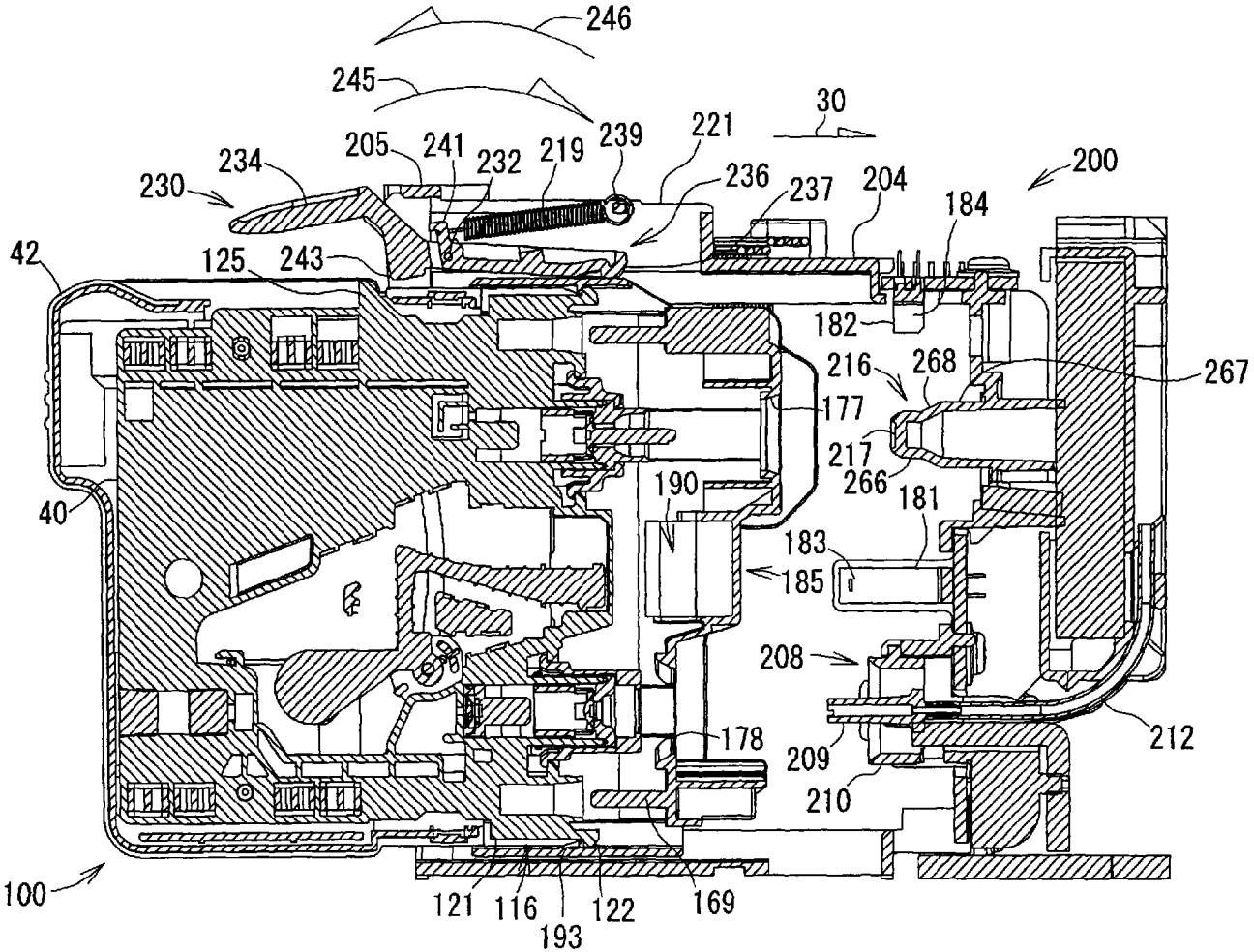
FIG. 9 is a cross-sectional view of the ink cartridge of FIGS. 1(A) and 1(B) and the cartridge mounting portion of FIG. 6, in which the ink cartridge is partially inserted in the cartridge mounting portion, and springs of an air communication valve mechanism and an ink supply valve mechanism of the ink cartridge are omitted.
Figure 10:
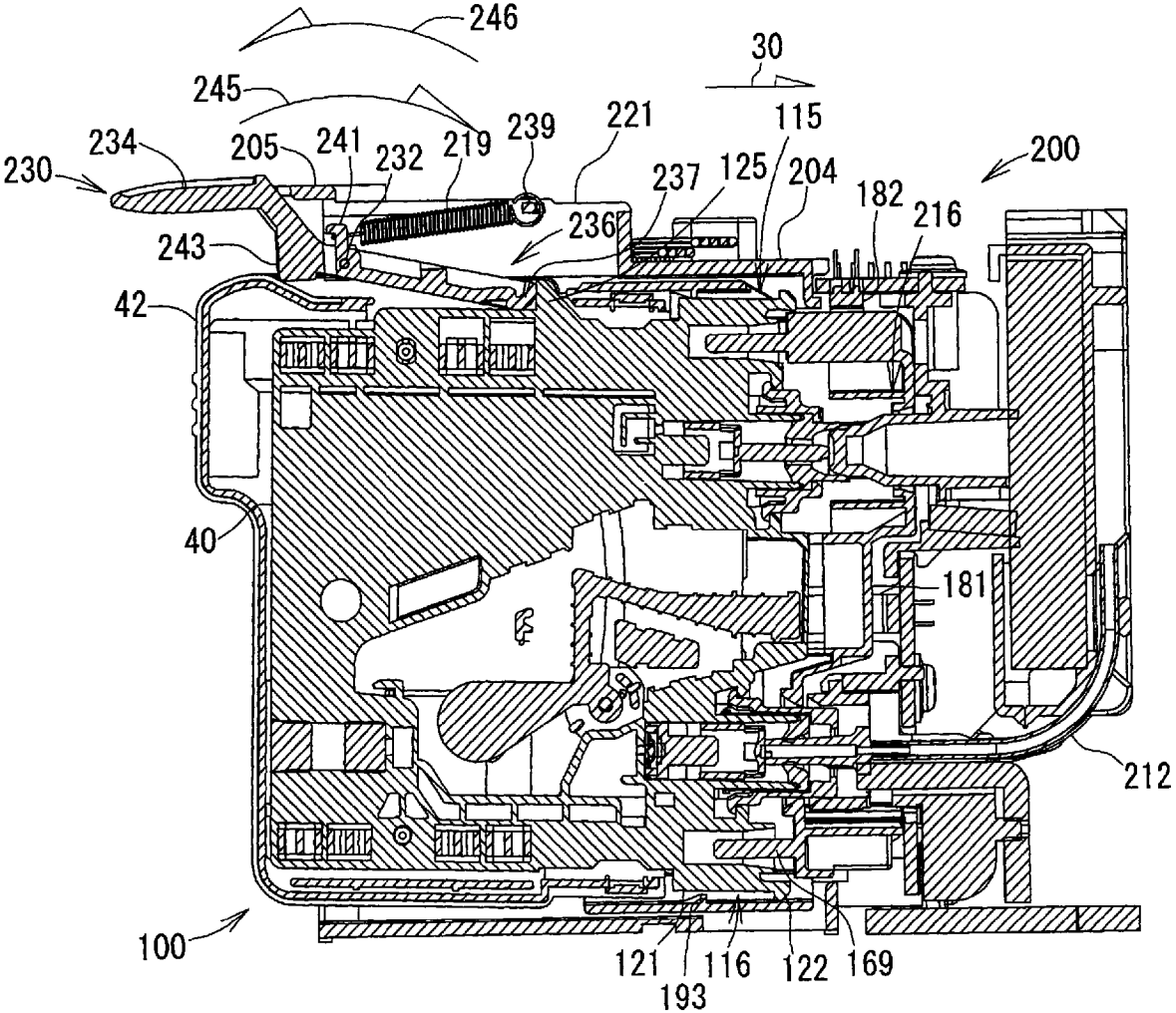
FIG. 10 is a cross-sectional view of the ink cartridge of FIGS. 1(A) and 1(B) and the cartridge mounting portion of FIG. 6, in which the ink cartridge is inserted in the cartridge mounting portion and is mounted to the cartridge mounting portion, and springs of an air communication valve mechanism and an ink supply valve mechanism of the ink cartridge are omitted.

Coil spring 96 may be positioned in valve chamber 54, and may be configured to expand and contract in depth direction 33. Coil spring 96 may contact and apply a biasing force to valve element 97 toward ink supply opening 91 in depth direction 33. Therefore, when no external force is applied to valve element 97 in depth direction 33, second lid member 97 may be in the seventh position. Referring to FIGS. 9 and 10, during the mounting of ink cartridge 10 to cartridge mounting portion 200, ink tube 209 may be inserted into ink supply opening 91, and ink tube 209 may contact and apply a pressing force to valve element 97. When valve element 97 receives the pressing force from ink tube 209, valve element 97 may move away from sealing member 93 against the biasing force of coil spring 96. Ink supply opening 91 may be thus uncovered, and ink may be supplied from ink chamber 102 to the recording head via valve chamber 54 and ink tube 209

Referring to FIG. 4, a spring chamber 110 may be formed in front wall 34 between valve chamber 55 and top wall 36. Similarly, a spring chamber 111 may be formed in front wall 34 between valve chamber 54 and bottom wall 37. Spring chambers 110 and 111 may be substantially circular, cylindrical chambers extending from front wall 34 toward ink chamber 102. Coil springs 48 and 49 may be positioned within valve chambers 110 and 111, respectively. For example, coil springs 48 and 49 may be coupled to front wall 34 of case 40 at one end and may be coupled to front wall 161 of slider 41 at the other end. Specifically, coil springs 48 and 49 may be coupled to front wall 34 and front wall 161 by direct contact between coil springs 48 and 49 and front wall 34 and front wall 161, or by indirect contact between the coil springs 48 and 49 and front wall 34 and front wall 161.

When coil springs 48 and 49 indirectly contact front wall 34 and front wall 161, at least one other element is positioned between coil springs 48 and 49 and front wall 34 and front wall 161, respectively. Coil springs 48 and 49 may be configured to bias slider 41 away from front wall 34 of case 40, and into the first position by applying a biasing force to front wall 161 of slider 41. Moreover, in order to stably and evenly bias slider 41, spring chamber 110 and spring chamber 111 may be separated from each other in height direction 32, e.g., spring chamber 110 and spring chamber 111 may be positioned adjacent to opposite ends of front wall 34 in height direction 32.

A supporting member 115 may formed at a front end of the top wall 36. Supporting member 115 may support slider 41, such that slider 41 may slide with respect to case 40, and supporting member 115 may limit the sliding range of slider 41. Supporting member 115 may be integral with frame 50, and may comprise a base portion 118 extending vertically upward from top wall 36, and a hook portion 119 extending from a front end of base portion 118.

Supporting member 116 may have substantially the same shape as supporting member 115, and may be positioned at a front end of bottom wall 37. Supporting member 116 may be integral with frame 50, and may comprise a base portion 121 extending vertically downward from bottom wall 37, and a hook portion 122 extending from a front end of base portion 121. Slider 41 may be slidably supported at two points by supporting member 115 and supporting member 116.

Referring to FIGS. 3(A) to 4, top wall 36 may comprise a platform 124. Platform 124 may extend from an intermediate position of top wall 36 toward rear wall 35 with respect to depth direction 33, but may not reach rear wall 35. Referring to FIGS. 1(A) and 1(B), platform 124 may be exposed to the exterior of case cover 42 via an opening 128 formed through a top face of case cover 42.

Frame 50 may comprise a stopper 125 positioned at the front end of platform 124 and extending outward from platform 124 in height direction 32. Stopper 125 may comprise a vertical wall 126 extending from platform 124, and also may comprise a slant rib 127 extending from an end of vertical wall 126 to a particular portion of top wall 36, and the particular portion may be positioned closer to front wall 34 than platform 124 is positioned to front wall 34. The end of vertical wall 126 may be positioned opposite from platform 124. An angle between vertical wall 126 and platform 124 may be about 90 degrees, and an angle between slant rib 127 and vertical wall 126 may be about 45 degrees. Further, when ink cartridge 100 is mounted to cartridge mounting portion 200, stopper 125 may contact a lock lever 230 of cartridge mounting portion 200, and ink cartridge 100 may not be removed from cartridge mounting portion 200.

Referring to FIG. 1(A) to FIG. 2(B), case cover 42 may have a container shape, and may be configured to accommodate substantially the entirety of case 40 except for front wall 34. Case cover 42 may have a flat shape corresponding to the outer shape of case 40. Case 40 may have a plurality of openings 130 formed therethrough in width direction 31. Four openings 130 may be positioned adjacent to top wall 36, and another four openings 130 may be positioned adjacent to bottom wall 37.

Case cover 42 may comprise a shoulder 43 at each of side faces of case cover 42 at a middle portion, with respect to depth direction 33. Shoulder 43 may have a substantially arcuate shape, and may extend from the top of case cover 42 to the bottom of case cover 42. Case cover 42 may have a rear portion 47 positioned at the rear of shoulder 43 and a front portion 46 positioned at the front of shoulder 43 with respect to insertion direction 30. Front portion 46 may have a width which is less than a width of rear portion 47 in width direction 31. Rear portion 47 may have opening 128 formed through the top face of rear portion 47. Platform 124 and stopper 125 may be exposed to the exterior of case cover 42 via opening 128.

Case cover 42 may comprise a left cover 44 and a right cover 45. Left cover 44 and right cover 45 may be substantially symmetrical with respect to a plane defined by height direction 32 and depth direction 33. Referring to FIG. 4, left cover 44 and right cover 45 each may comprise a plurality of engaging claws 132 projecting from the inner surface thereof. The distal end of each of engaging claws 132 may have a hook shape. Engaging claws 132 may be fitted into openings 130 of case 40, and the hook-shaped distal ends of engaging claws 132 may be caught by case 40 at openings 130. Accordingly, left cover 44 may be mounted on a left wall 38 side of case 40, and right cover 45 may be mounted on a right wall 39 side of case 40, and left cover 44 and right cover 45 may be joined.

Referring to FIG. 1(A) to FIG. 2(B), slider 41 may have a container shape, and may be configured to accommodate front portion 46 of case cover 42 and a front wall 34 side of case 40 therein. Slider 41 may have a substantially flat shape corresponding to front portion 46 of case cover 42 and front wall 34 of case 40. Slider 41 may comprise front wall 161 facing front wall 34 of case 40, a top wall 163 facing the top face of front portion 46 of case cover 42, a bottom wall 164 facing the bottom face of front portion 46 of case cover 42, a left wall 165 facing the left side face of front portion 46 of case cover 42, and a right wall 166 facing the right side face of front portion 46 of case cover 42. The walls 161 and 163-166 may define a space therein which is configured to accommodate to front portion 46 of case cover 42 and front wall 34 of case 40.

Left wall 165 and right wall 166 may extend from front wall 161 in depth direction 33 and may cover front portion 46 of case cover 42 therebetween. Therefore, when slider 41 slides, front portion 46 of case cover 42 may act as guide surface for left wall 165 and right wall 166, such that slider 41 slides smoothly along the guide surface. Slider 41 may comprise a signal blocking portion 185, a signal blocking portion 186, a cutout 187 formed therethrough, supporting bars 168 and 169, slide grooves 171 and 172, a guide opening 177, an opening 178 formed therethrough, and protrusion 175.

Figure 8:
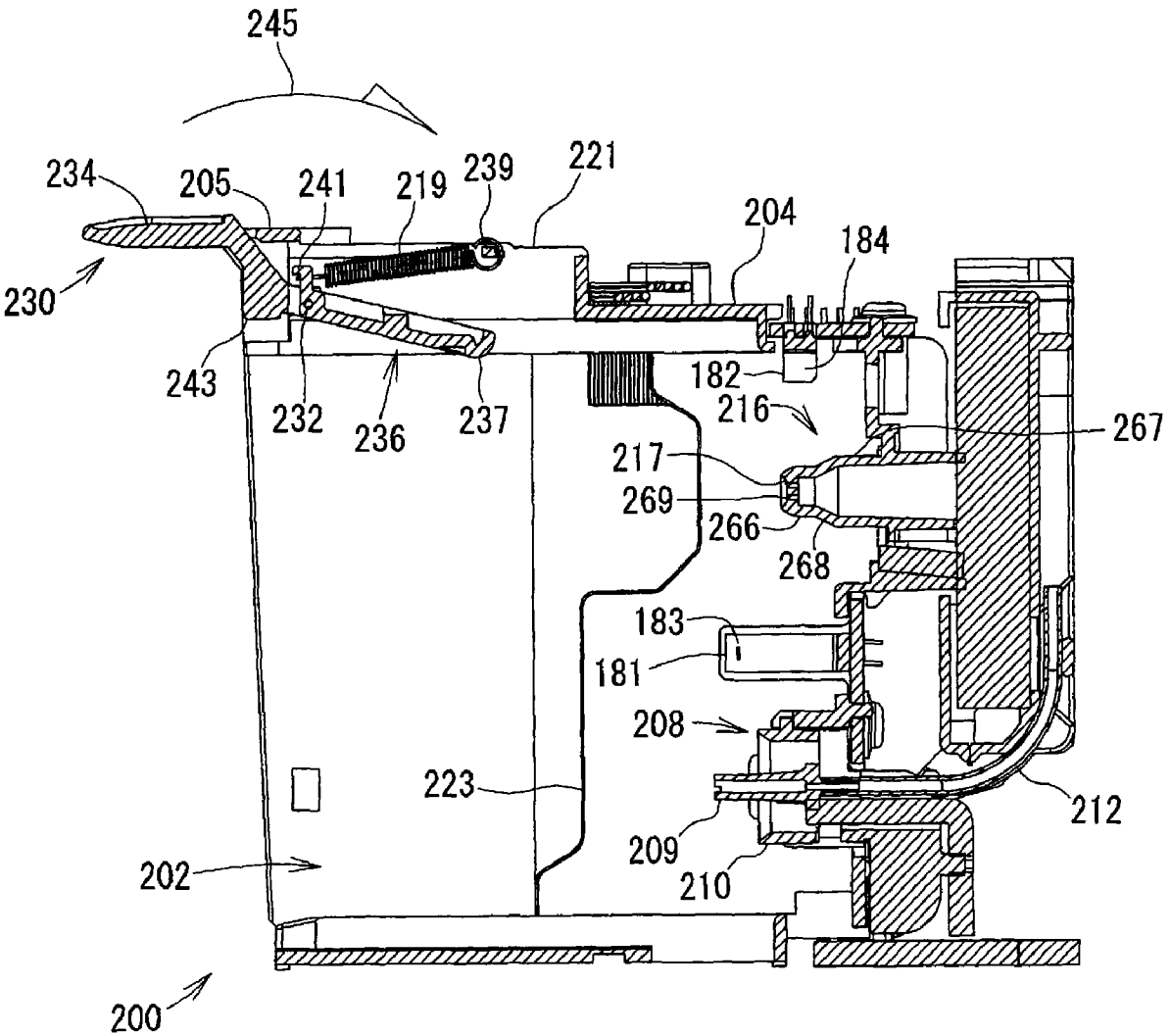
FIG. 8 is a cross-sectional view of the cartridge mounting portion taken along line VIII-VIII in FIG. 7.

Referring to FIG. 1(A) to FIG. 2(B), cutout 187 may be formed at a center of front wall 161, and cutout 187 may be configured to expose translucent portion 140 to the exterior of slider 41 when slider 41 is in the second position. For example, cutout 187 may be formed by removing rectangular portions which rectangular portions face translucent portion 140, e.g., rectangular portions from front wall 161 and left wall 165 and right wall 166. Cutout 187 may extend from front wall 161 in a rearward direction, with respect to insertion direction 30. Referring to FIGS. 8 to 10, when ink cartridge 100 is mounted to cartridge mounting portion 200, a light-emitting element and a light-receiving element of optical sensor 181 may be positioned with the cutout 187 positioned between them. Therefore, light emitted from the light-emitting element may pass through cutout 187, and irradiation portion 144 of side wall 146 of translucent portion 140 may be irradiated with the light.

Referring to FIG. 1(A) to FIG. 2(B), signal blocking portion 185 may be bridged over cutout 187 in height direction 32 at front wall 161. A space 190 may be formed behind signal blocking portion 185 by signal blocking portion 185 and cutout 178. Referring to FIGS. 8 to 10, signal blocking portion 185 may be configured to enter into optical path 183 of optical sensor 181 during the mounting of the ink cartridge 100 to the cartridge mounting portion 200. Signal blocking portion 185 may comprise an opaque resin material which is configured to block light e.g., configured not to allow light, or a portion of the light, to pass therethrough.

The dimension of signal blocking portion 185 in depth direction 33 may differ depending on the type of ink cartridge 100. The difference in the dimension of signal blocking portion 185 may be detected by a controller of the image forming apparatus monitoring a signal outputted from optical sensor 181 during the mounting of ink cartridge 100 to cartridge mounting portion 200. By the detection of the difference in the dimension of signal blocking portion 185, the type of the ink cartridge 100 mounted to cartridge mounting portion 200 may be determined by the controller.

Referring to FIG. 1(A) to FIG. 2(B), signal blocking portion 186 may extend from the bottom of a recess 194 formed in a front end of top wall 163. Referring to FIGS. 8 to 10, signal blocking portion 186 may be configured to enter into an optical path 184 of an optical sensor 182 during the mounting of the ink cartridge 100 to the cartridge mounting portion 200. Signal blocking portion 186 may comprise an opaque resin material which is configured to block light, e.g., configured not to allow light to pass therethrough. The controller may determine whether ink cartridge 100 is mounted to cartridge mounting portion 200 by monitoring a signal outputted from optical sensor 182.

Projection 175 may extend from front wall 161 at a position where front wall 161 and bottom wall 164 meet. Projection 175 may extend in insertion direction 30, which is parallel to depth direction 33. Projection 175 may be configured to receive an ink droplet dropping from ink tube 209 or ink supply opening 91 when ink cartridge 100 is removed from cartridge mounting portion 200.

Referring to FIG. 4, supporting bar 168 may be configured to support coil spring 48, and supporting bar 169 may be configured to support coil spring 49. Supporting bars 168 and 169 may be positioned on a surface of front wall 161 facing front wall 34 of case 40. Supporting bar 168 may be at a position corresponding to spring chamber 110, and supporting bar 169 may be at a position corresponding to spring chamber 111.

Supporting bars 168 and 169 may extend from the surface of front wall 161 in depth direction 33 of case 40. Coil spring 48 may be positioned in spring chamber 110 and coil spring 49 may be positioned in spring chamber 111, and supporting bar 168 may be inserted into coil spring 48 and supporting bar 169 may be inserted into coil spring 49. Coil springs 48 and 49 may be supported by supporting bars 168 and 169, respectively. The direction of expansion and contraction of coil springs 48 and 49 may be limited to depth direction 33.

Coil springs 48 and 49 may comprise compression coil springs, e.g., coil springs 48 and 49 may be compressed and stored in spring chambers 110 and 111. Therefore, coil springs 48 and 49 may bias slider 41 into the first position independent of the initial position of slider 41. Referring to FIGS. 1(A) and 1(B), slide groove 171 may be formed in top wall 163, and a cross-sectional shape of slide groove 171 may have a substantially inverted U-shape. Referring to FIG. 4, supporting member 115 may be inserted into slide groove 171. A projecting strip 192 may extend from a bottom surface of top wall 163 toward the interior of slide groove 171. Therefore, slide groove 171 may be narrowed in part by projecting strip 192. Similarly, slide groove 172 may be formed in bottom wall 164, and a cross-sectional shape of slide groove 172 may have a substantially U-shape. Supporting member 116 may be inserted into slide groove 172, and a projecting strip 193 may extend from a top surface of bottom wall 164 toward the interior of the slide groove 172. Therefore, slide groove 172 may be narrowed in part by projecting strip 183.

During manufacturing of ink cartridge 10, when case 40 is inserted into slider 41, supporting member 115 may be inserted into slide groove 171, and supporting member 116 may be inserted into slide groove 172. When supporting member 115 is inserted into slide groove 171, projecting strip 192 and the hook portion 119 may contact each other. Then, when supporting member 115 is further inserted, supporting member 115 may resiliently bend, and hook portion 119 may climb over projecting strip 192. When hook portion 119 has climbed over projecting strip 192 once, slider 41 and case 40 may not be disassembled, because hook portion 119 is received by projecting strip 192 when the disassembly is attempted. Supporting member 116 also may be inserted into slide groove 172 in the same manner.

Slider 41 may be biased into the first position by coil springs 48 and 49. Therefore, unless an external force is applied to slider 41, slider 41 may remain in the first position by the contact between projecting strip 192 and hook portion 119 and the contact between projecting strip 193 and hook portion 122. Nevertheless, when an external force is applied to the front face of front wall 161 of slider 41, slide 41 may slide from the first position to the second position.

Referring to FIGS. 1 and 4, guide opening 177 may be formed through front wall 161 at a position adjacent to top wall 163. Guide opening 177 may be positioned between signal blocking portion 186 and translucent portion 140. Guide opening 177 may be formed at a position corresponding to air communication valve mechanism 80. Guide opening 177 may have a diameter, such that a large-diameter portion 267 of a projection 216 of cartridge mounting portion 200 may be inserted into guide opening 177 during the mounting of ink cartridge 100 into cartridge mounting portion 200. Moreover, the peripheral edge of guide opening 177 may be configured to contact and slide on the outer peripheral surface of large-diameter portion 267 when large-diameter portion 267 is inserted into guide opening 177.

Referring to FIGS. 1 and 4, opening 178 may be formed through front wall 161 at a position adjacent to bottom wall 164, and may be formed at a position corresponding to ink supply portion 90. The diameter of opening 178 may be greater than the diameter of cap 95 of ink supply portion 90, such that cap 95 may be inserted into and through opening 178. When slider 41 is in the first position, the entire ink supply portion 90 may be positioned within slider 41, such that the entire ink supply portion 90 is recessed from opening 178. When slider 41 moves from the first position to the second position, at least a portion of cap 95 may move into and then may pass through opening 178 to protrude from front wall 161.

Referring to FIG. 6, cartridge mounting portion 200 may comprise a frame 204 having a substantially rectangular, parallelepiped shape. Frame 204 may have a front opening 207 formed therethrough. A cartridge accommodating space 202 may be formed in frame 204, and when ink cartridge 100 is mounted to cartridge mounting portion 200, ink cartridge 100 may be accommodated in cartridge accommodating space 200. Cartridge accommodating space 202 may be configured to accommodate four ink cartridges 100 storing different color inks, e.g., cyan ink, magenta ink, yellow ink, and black ink, respectively.

Referring to FIGS. 6 and 8, cartridge mounting portion 200 may comprise three plates 223, which may partition cartridge accommodating space 202 into four spaces which are longer in the vertical direction than in the width or depth direction. Four ink cartridges 100 may be accommodated in the respective spaces partitioned by plates 223. Frame 204 may comprise an end surface opposite opening 207. Plates 223 may extend from the end surface of frame 204 toward opening 207. Cartridge mounting portion 200 may have a width in a width direction of cartridge mounting portion 200 and a depth in a depth direction of cartridge mounting portion 200. The depth direction of cartridge mounting portion 200 may extend from opening 207 to the end surface of frame 204, and the width direction of cartridge mounting portion 200 may be perpendicular to the depth direction of cartridge mounting portion 200. Plates 223 may be arranged in the width direction of cartridge mounting portion 200.

Frame 204 may comprise a bottom inner surface, and may have four guide grooves 206 formed in the bottom inner surface thereof. Guide grooves 206 may be configured to smoothly guide ink cartridges 100 relatively deep into cartridge accommodating space 202 when ink cartridges 100 are inserted into cartridge accommodating space 202. Guide grooves 206 may extend straight from opening 207 in the depth direction of cartridge mounting portion 200. Guide grooves 206 may be aligned at a predetermined interval in the width direction of cartridge mounting portion 200. As shown in FIG. 6, the leftmost guide groove 206 may be configured to receive black ink cartridge 100, and may be wider than the other guide grooves 206 in the width direction of cartridge mounting portion 200.

Leftmost guide groove 206 may be wider than other guide grooves 206 to accommodate black ink cartridge 100, which may be wider in width direction 31 than the other ink cartridges 100. Ink cartridge 100 may be smoothly inserted into cartridge accommodating space 202 in insertion direction 30, while a bottom portion of ink cartridge 100 is guided by the corresponding guide groove 206. When ink cartridge 100 is mounted to cartridge mounting portion 200, width direction 31 may correspond to the width direction of cartridge mounting portion 200, depth direction 33 may correspond to the depth direction of cartridge mounting portion 200, and height direction 31 may correspond to a height direction of cartridge mounting portion 200. The height direction of cartridge mounting portion 31 may be perpendicular to each of the width direction and the depth direction of cartridge mounting portion 200.

Referring to FIG. 8, cartridge mounting portion 200 may comprise projections 216 extending from the end surface of frame 204. Projections 216 may be positioned at positions which correspond to the respective air communication valve mechanisms 80 of ink cartridges 100. When ink cartridge 100 is mounted to cartridge mounting portion 200, projection 216 may contact and push rod 84 of air communication valve mechanism 80 via guide opening 177 of slider 41. In this embodiment, four projections 216 may be provided, which may correspond to four ink cartridges 100, respectively.

Referring again to FIG. 8, projection 216 may extend from the end surface of frame 204 in a direction perpendicular to the end surface of frame 204. Projection 216 may extend in a direction opposite insertion direction 30 of ink cartridge 100. When ink cartridge 100 is inserted into cartridge accommodating space 202, projection 216 may pass through guide opening 177 of slider 41. The length of projection 216 may be selected such that projection 216 may begin passing through guide opening 177 before other members positioned at the end surface of frame 204 contact or move into ink cartridge 100, when ink cartridge 100 is inserted into cartridge accommodating space 202.

When projection 216 is inserted through guide opening 177 of slider 41, slider 41 may be positioned in a correct position in relation to frame 204, guided by projection 216 and guide opening 177. Projection 216 may have a substantially circular, cylindrical shape, and may extend through the end surface of frame 204. Projection 216 may have a first end positioned in cartridge accommodating space 202 and away from the end surface of frame 204, and a second end opposite the first end of projection 216. The second end of projection 216 may be positioned in the exterior of frame 204. Projection 216 also may have an inner space formed therein, and the inner space may be open to the exterior of projection 216 at the second end of projection 216. The inner space of projection 216 may extend from the second end of projection 216 toward the first end of projection 216.

A round recess 217 may be formed at the first end of projection 216. A diameter of recess 217 may be greater than an outer diameter of the end of rod 84 of air communication valve mechanism 80. A plurality of openings 269 may be formed through the bottom of recess 217. Each opening 269 may be positioned away from the center of recess 217 in a radial direction of recess 217. The inner space of projection 216 may be continuous with openings 269, and the inner space of projection 216 may be in fluid communication with the exterior of projection 216 via openings 269.

Projection 216 may comprise a small-diameter portion 266 and large-diameter portion 267. Small-diameter portion 266 may comprise the first end of projection 216, and large-diameter portion 267 may be connected to the end surface of frame 204. An outer diameter of large-diameter portion 267 may be greater than an outer diameter of small-diameter portion 266. A slant portion 268 may be formed between small-diameter portion 266 and large-diameter portion 267.

Referring still to FIG. 8, cartridge mounting portion 200 may comprise connecting portions 208 positioned at the end surface of frame 204. Connecting portion 208 may be configured to contact the ink supply valve mechanism 90 of ink cartridge 100 when ink cartridge 100 is mounted to cartridge mounting portion 200. In an embodiment, four connecting portions 208 may be provided corresponding to the four ink cartridges 100. In FIG. 6, one of the four connecting portions 208 is not illustrated because the right side wall of frame 204 obstructs the view of one of the four connecting portions 208.

Connecting portion 208 may comprise ink tube 209 and a holding portion 210. Ink tube 209 may comprise a rigid resin. Ink tube 209 may be connected to a flexible ink tube 212 which may be connected to the recording head of the image forming apparatus.

Holding portion 210 may have a round recess formed therein, and ink tube 209 may be positioned at the center of the recess of holding portion 210. When ink cartridge 100 is mounted to cartridge mounting portion 200, cap 95 of ink supply valve mechanism 90 may be inserted into the recess of holding portion 210. An outer surface of cap 95 may contact a surface of the recess of holding portion 210, such that cap 95 is securely held in holding portion 210.

Referring to FIG. 8, cartridge mounting portion 200 may comprise optical sensors 181 positioned at the end surface of frame 204. Optical sensors 181 may be positioned to correspond to translucent portions 140 of ink cartridges 100, respectively. Each optical sensor 181 may be used for determining whether the amount of ink stored in the respective ink chamber 102 is sufficient, and for determining the type of the respective ink cartridge 100. Frame 204 may comprise a top inner surface opposite the bottom inner surface of frame 204. Cartridge mounting portion 200 also may comprise optical sensors 182 positioned at the top inner surface of frame 204 adjacent to the end surface of frame 204. Each one of optical sensor 182 may be used for detecting whether a corresponding one of ink cartridges 100 is mounted to cartridge mounting portion 200. In this embodiment, four sets of optical sensors 181 and 182 may be provided corresponding to four ink cartridges 100. In FIG. 6, one of the four optical sensors 181 is not illustrated because the right side wall of frame 204 obstructs the view of this one of the optical sensors 181.

Each of optical sensors 181 and 182 may comprise a light-emitting element and a light-receiving element. Optical path 183 may be formed between the light-emitting element and the light-receiving element of optical sensor 181. Similarly, optical path 184 may be formed between the light-emitting element and the light-receiving element of optical sensor 182. Signal blocking portion 185 and translucent portion 140 may enter into optical path 183, and signal blocking portion 186 may enter into optical path 184. Optical sensor 182 may be positioned above projection 216, projection 216 may be positioned above optical sensor 181, and optical sensor 181 may be positioned above connecting portion 208.

Referring to FIG. 8, cartridge mounting portion 200 may comprise lock levers 230 positioned adjacent to a top edge of opening 207 of frame 204. Lock lever 230 may be configured to contact ink cartridge 100 positioned in cartridge accommodating space 202 such that ink cartridge 100 does not detach from cartridge mounting portion 200. In an embodiment, four lock levers 230 may be provided, corresponding to four ink cartridges 100. With lock lever 230, ink cartridge 100 may be retained in cartridge accommodating space 202.

Lock lever 230 may comprise a support shaft 232. Support shaft 232 may be supported by frame 204 at a position adjacent to a top edge of opening 207 of frame 204, such that lock lever 230 may pivot about support shaft 232. Lock lever 230 may comprise a push portion 234, an action portion 236, and an engagement portion 243. Engagement portion 243 may extend from support shaft 243 toward the exterior of frame 204, e.g., to the left when positioned as shown in FIG. 8. Push portion 234 may extend from engagement portion 243 to the exterior of frame 204, e.g., to the left when positioned as shown in FIG. 8, and action portion 236 may extend from support shaft 232 toward the end surface of frame 204, e.g., to the right when positioned as shown in FIG. 8. Push portion 234 may have a shallow recess formed in its top surface, such that a user readily may apply a downward force to push portion 234 with their finger contacting the recess of push portion 234.

When the user applies the downward force to push portion 234, engagement portion 243 may move into cartridge accommodating space 202 to a position in which a bottom portion of engagement portion 243 may contact a top portion of ink cartridge 100. Action portion 236 may comprise a contact portion 237 positioned at an end of action portion 236 opposite from support shaft 232. Contact portion 237 may be configured to contact stopper 125 of ink cartridge 100, and a bottom portion of contact portion 237 may be curved. A portion of action portion 236 between support shaft 232 and contact portion 237 may be a substantially straight portion.

Referring to FIG. 8, cartridge mounting portion 200 may comprise pull springs 219 positioned above action portions 236 of lock levers 230, respectively. One end of pull spring 219 may be attached to frame 204 above contact portion 237. More specifically, frame 204 may comprise a flat plate 221 extending upward from a top surface of frame 204, and a hook portion 239 extending from plate 221 horizontally in the width direction of cartridge mounting portion 200. The one end of pull spring 219 may hook over hook portion 239, and the other end of pull spring 219 may hook over an L-shaped hook portion 241 extending upward from support shaft 232. The position of hook portion 241 may be slightly lower than the position of hook portion 239. Pull spring 219 may hook over hook portions 239 and 241 while pull spring 219 is expanded from its original length, such that pull spring 219 attempts to contract to its original length. Therefore, lock lever 230 may receive a force from pull spring 219, such that lock lever 230 may pivot in a direction 245 shown in FIG. 8, e.g., a clockwise direction in FIG. 8.

Frame 204 may comprise a stopper 205. The pivotal movement of lock lever 230 caused by pull spring 219 may be stopped when lock lever 230 reaches stopper 205. When no external force is applied to push portion 234, lock lever 230 may remain in a position in which lock lever 230 contacts stopper 205. When lock lever 230 is in the position in which lock lever 230 contacts stopper 205, push portion 234 may extend horizontally, and contact portion 237 may contact stopper 125 of ink cartridge 100.

Referring to FIGS. 9 to 10, a method of mounting ink cartridge 100 to cartridge mounting portion 200 is described. Referring to FIG. 9, when ink cartridge 100 is inserted into cartridge accommodating space 202 in insertion direction 30 via opening 207 of frame 204, a top-front end of ink cartridge 100 may contact the contact portion 237 of lock lever 230, which may cause ink cartridge 100 to push up contact portion 237. As a result, lock lever 230 may pivot in a direction 246 shown in FIG. 9, e.g., a counterclockwise direction in FIG. 9, against the pulling force of pull spring 219. Further, push portion 234 may slightly incline downward. As such, the position of push portion 234 may change from a position in which push portion 234 extends horizontally to a position in which push portion 234 is inclined.

When ink cartridge 100 is inserted further into cartridge accommodating space 202, small-diameter portion 266 of projection 216 may be inserted into guide opening 177 of slider 41. Guide opening 177 may have a center line extending in depth direction 33, and projection 216 may have a center line extending in the depth direction of cartridge mounting portion 200. Even if the center line of projection 216 is not aligned with the center line of guide opening 177, small-diameter portion 266 may be inserted into guide opening 177 because an outer diameter of small-diameter portion 266 is less than an diameter of guide opening 177, thereby facilitating insertion of small-diameter portion 266 into guide opening 177.

When ink cartridge 100 is inserted further, slant portion 268 of projection 216, and large-diameter portion 267 of projection 216 sequentially may be inserted into opening 177. Similarly to the insertion of small-diameter portion 266, even when the center line of guide opening 177 is not aligned with the center line of projection 216, large-diameter portion 267 may be guided into guide opening 177 through contact between slant portion 268 and the peripheral edge of guide opening 177, such that slant portion 268 may slide on the peripheral edge of guide opening 177.

Because guide opening 177 has a diameter configured to cause the peripheral edge of guide opening 177 to contact and slide on the outer peripheral surface of large-diameter portion 267 when ink cartridge 100 is inserted, the center line of guide opening 177 may be aligned with the center line of projection 216 when large-diameter portion 267 is inserted into guide opening 177. Accordingly, guide opening 177 may be positioned in a correct position in relation to projection 216.

Slider 41 also may be positioned in a correct position relative to projection 216 in cartridge accommodating space 202. When slider 41 is positioned in a correct position in relation to projection 216, case 40, which may be coupled to slider 41, may be positioned in a correct position in relation to projection 216. Further, air communication opening 81, ink supply opening 91, signal blocking portion 186, signal blocking portion 185, and translucent portion 140 may be positioned in a correct position in relation to projection 216. Moreover, air communication opening 81 may be positioned in a correct position in relation to projection 216, ink supply opening 91 may be positioned in a correct position in relation to ink tube 209, signal blocking portion 186 may be positioned in a correct position in relation to optical sensor 182, and signal blocking portion 185 and translucent portion 140 may be positioned in a correct position in relation to sensor 181.

When ink cartridge 100 is inserted further, signal blocking portion 185 may enter into optical path 183 of optical sensor 181, and signal blocking portion 186 may enter into optical path 184 of optical sensor 182. Because of the correct positioning of guide opening 177 in relation to projection 216, signal blocking portions 185 and 186 may be positioned in a correct position relative to optical sensors 181 and 182, respectively. Signal blocking portions 185 and 186 may be reliably irradiated with light emitted from optical sensors 181 and 182. Accordingly, optical sensors 181 and 182 accurately may detect signal blocking portions 185 and 186.

When ink cartridge 100 is inserted still further, front wall 161 of slider 41 may contact the end surface of frame 204. When this occurs, signal blocking portion 185 may be out of optical path 183 of optical sensor 181, and opening 190 may be in optical path 183 instead. Signal blocking portion 186 may remain in optical path 184.

When ink cartridge 100 is pushed in insertion direction 30 while slider 41 contacts the end surface of frame 204, coil springs 48 and 49 may be positioned between slider 41 and case 40, and may be compressed. As a result, case 40 may move in insertion direction 30 while slider 41 may remain stationary, with respect to frame 204, e.g., case 40 may move closer to slider 41 from the first position to the second position. By contacting and sliding on the inner surface of slider 41, while case 40 is moving, the direction of movement of case 40 may be restricted in insertion direction 30.

When case 40 moves to the second position, e.g., when case 40 is inserted at its deepest position into cartridge accommodating space 202, rod 84 may contact the first end of projection 216. When this occurs, the end of rod 84 may move into recess 217 of projection 216, and reliably may be secured in recess 217. Because rod 84 is positioned in a correct position in relation to projection 216 due to the correct positioning of guide opening 177 in relation to projection 216, rod 84 readily may contact projection 216. When rod 84 receives a force from projection 216, rod 84 may move and lid 88 may separate from scaling member 83.

As a result, air communication opening 81 may be uncovered and the pressure in ink chamber 102 may increase to a pressure that is equal to atmospheric pressure. When rod 84 moves further, small-diameter portion 266 of projection 216 may be inserted into sealing member 83. When this occurs, sealing member 83 may elastically deform to provide a liquid tight contact with small-diameter portion 266. As such, a fluid-tight seal may be provided between sealing member 83 and small-diameter portion 266. Air communication opening 81 may be in gaseous communication with the atmosphere via openings 269 and inner space of projection 216.

When case 40 moves to the second position, cap 95 of ink supply valve mechanism 90 may emerge from slider 41 via opening 178 to the exterior of slider 41, and ink tube 209 may be inserted into ink supply opening 91. Ink tube 209 may contact and push valve element 97, and valve element 97 may separate from sealing member 93. As a result, ink stored in ink chamber 102 may be supplied to the recording head of the image forming apparatus via ink tube 209 and flexible ink tube 212. Moreover, translucent portion 140 may intersect with optical path 183 of optical sensor 181 via opening 190.

As a result, irradiation portion 144 of translucent portion 140 may be irradiated with light emitted from the light-emitting element of optical sensor 181. Because ink supply opening 91 is positioned in a correct position in relation to ink tube 209 due to the correct positioning of guide opening 177 in relation to projection 216, ink tube 209 readily may be inserted into ink supply opening 91. Moreover, because translucent portion 140 is positioned in a correct position in relation to optical sensor 181 due to the correct positioning of guide opening 177 in relation to projection 216, translucent portion 140 readily may be irradiated with light emitted from optical sensor 181.

When ink cartridge 100 is inserted into cartridge accommodating space 202, contact portion 237 of lock lever 230 may move toward the rear side of ink cartridge 100 while contact portion 237 slides on a top portion of ink cartridge 100 to slant rib 127. When case 40 moves to the position closest to slider 41, contact portion 237 may move to a position over stopper 125. When this occurs, action portion 236 may be pulled by pull spring 219, and action portion 236 may pivot in direction 245, such that contact portion 237 may move onto platform 124, and thereby may contact the stopper 125. This may prevent case 40 from moving backward due to the pushing force of coil springs 48 and 19 positioned between case 40 and slider 41. Ink cartridge 100 thus may remain in cartridge mounting portion 200.

As described above, when slider 41 is positioned in a correct position in relation to projection 216, various portions of case 40 may be positioned in the correct position. Consequently, breakage of the respective elements of ink cartridge 100 due to incorrect positioning between the respective elements of ink cartridge 100 and the respective elements of cartridge mounting portion 200 may be reduced or prevented.

Figure 11:
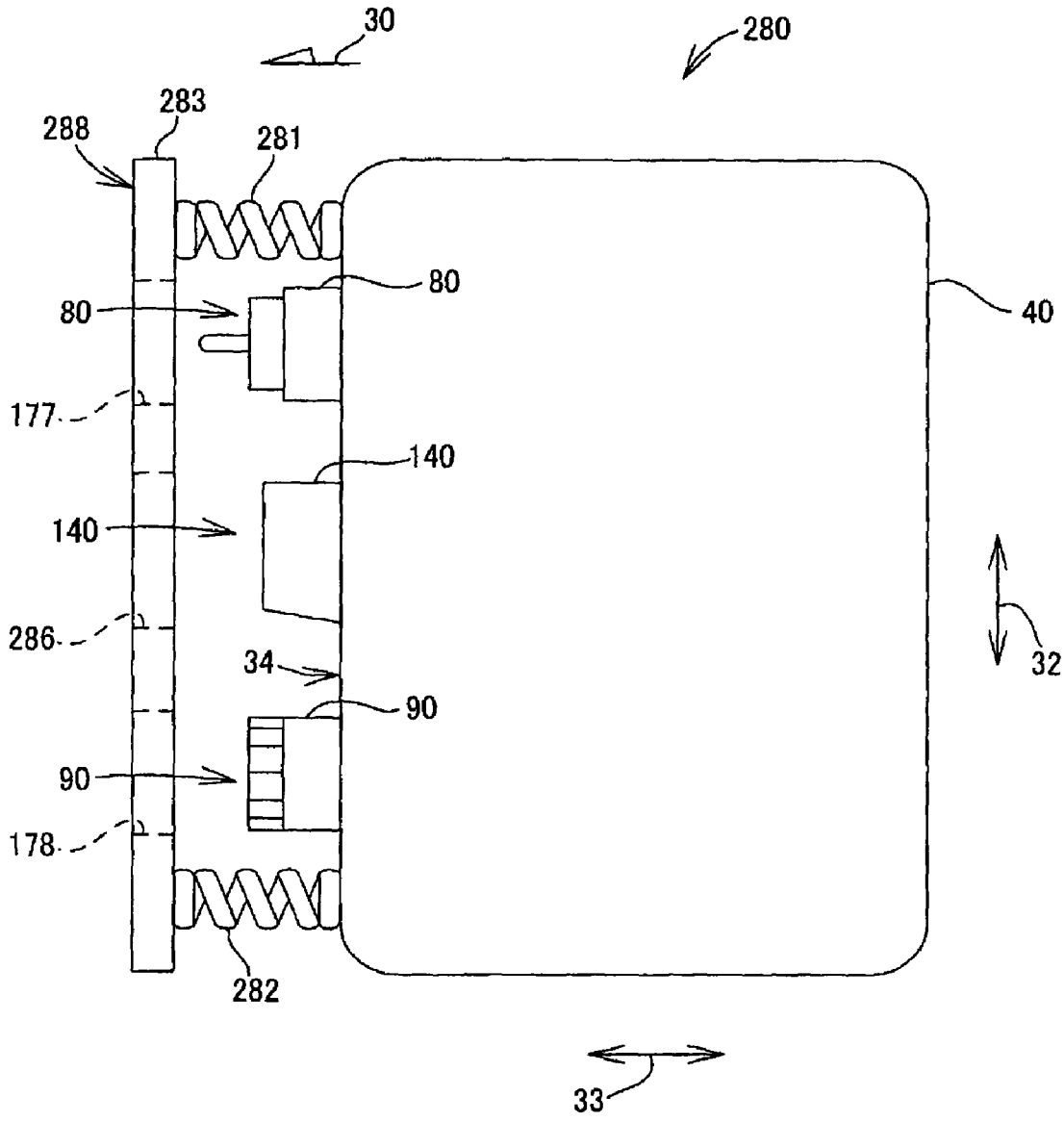
FIG. 11 is side view of an ink cartridge according to another embodiment of the present invention.

FIG. 11 shows an ink cartridge 280 according to another embodiment of the invention. Ink cartridge 280 may comprise a plated shaped cover 283 coupled to front wall 34 of case 40 of ink cartridge 280 via coil springs 281 and 282. Coil spring 281 may be positioned adjacent to the upper end of front wall 34, and coil spring 282 may be positioned adjacent to the lower end of front wall 34. Cover 283 may have guide opening 177 formed therethrough at a position corresponding to air communication valve mechanism 80. Cover 283 also may have an opening 286 formed therethrough at a position corresponding to translucent portion 140, and opening 178 formed therethrough at a position corresponding to ink supply valve mechanism 90. When an external force is not applied to cover 283, cover 283 may be in the first position in which cover 283 is positioned at a furthest position away from front wall 34 of case 40 in the range of motion of cover 283.

When ink cartridge 280 is inserted into cartridge mounting portion 200, projection 216 may be inserted into guide opening 177. When this occurs, cover 283 may be positioned in a correct position in relation to projection 216. When ink cartridge 280 is further inserted into the cartridge mounting portion 200 and is pressed against the end surface of frame 204, cover 283 may move toward front wall 34. When this occurs, coil springs 281 and 282 may be compressed and cover 283 may move to the second position in which cover 283 is positioned closest to front wall 34. Rod 84 of air communication valve mechanism 80 may be pushed by projection 216. Translucent portion 140 may be exposed from an outer surface 288 of cover 283 via opening 286, and ink supply valve mechanism 90 may be exposed from outer surface 288 of cover 283 via opening 178.

Because cover 283 is positioned in a correct position in relation to projection 216 by projection 216 being inserted into guide opening 177, rod 84 may be positioned in a correct position in relation to projection 216, ink supply opening 91 may be positioned in a correct position in relation to ink tube 209, and translucent portion 140 may be positioned in a correct position in relation to optical sensor 181.

While the invention has been described in connection with various exemplary structures and illustrative embodiments, it will be understood by those skilled in the art that other variations and modifications of the structures and embodiments described above may be made without departing from the scope of the invention. Other structures and embodiments will be apparent to those skilled in the art from a consideration of the specification or practice of the invention disclosed herein. It is intended that the specification and the described examples are illustrative with the true scope of the invention being defined by the following claims.

What is claimed is:

1. An ink cartridge comprising:

a case comprising:

an ink chamber configured to store ink therein;

a first wall facing an exterior of the case; and a translucent portion positioned at the first wall and having an inner space formed therein, wherein the inner space is continuous with the ink chamber;

a first movable member positioned in the case, and configured to move relative to an amount of ink stored in the ink chamber, wherein the first movable member comprises a particular signal blocking portion positioned in the inner space; and a second movable member coupled to the case, wherein the second movable member comprises a second wall facing the first wall, wherein the second wall has an opening formed therethrough, and the second movable member is configured to move between a first position and a second position, and the second wall is positioned closer to the first wall when the second movable member is in the second position than when the second movable member is in the first position.

2. The ink cartridge of claim 1, wherein the second movable member further comprises a further signal blocking portion, and the opening is positioned between the translucent portion and the further signal blocking portion.

3. The ink cartridge of claim 1, further comprising at least one resilient member having a first end coupled to the first wall and a second end coupled to the second wall, wherein the at least one resilient member is configured to apply a biasing force to the second wall to bias the second movable member into the first position.

4. An ink cartridge comprising:

a case comprising:

an ink chamber configured to store ink therein; and a first wall facing an exterior of the case;

an ink supply portion positioned at the first wall, and configured to supply ink from an interior of the ink chamber to an exterior of the ink chamber; and a particular movable member coupled to the case, wherein the particular movable member comprises a second wall facing the first wall, and the second wall has an opening formed therethrough, and wherein the particular movable member is configured to move between a first position and a second position, and the second wall is positioned closer to the first wall when the particular movable member is in the second position than when the particular movable member is in the first position.

5. The ink cartridge of claim 4, further comprising a further movable member positioned in the case, and configured to move relative to an amount of ink stored in the ink chamber, wherein the case comprises a translucent portion positioned at the first wall, the translucent portion has an inner space formed therein, and the inner space is continuous with the ink chamber, and wherein the further movable member comprises a particular signal blocking portion positioned in the inner space, and the translucent portion is positioned between the ink supply portion and the opening.

6. The ink cartridge of claim 4, further comprising at least one resilient member having a first end coupled to the first wall and a second end coupled to the second wall, wherein the at least one resilient member is configured to apply a biasing force to the second wall to bias the particular movable member into the first position.

7. An ink supply system comprising:

a cartridge mounting portion comprising a projection; and an ink cartridge configured to be removably mounted to the cartridge mounting portion, wherein the ink cartridge comprises:

a case comprising:

an ink chamber configured to store ink therein;

a first wall facing an exterior of the case; and a translucent portion positioned at the first wall and having an inner space formed therein, wherein the inner space is continuous with the ink chamber;

a first movable member positioned in the case, and configured to move relative to an amount of ink stored in the ink chamber, wherein the first movable member comprises a particular signal blocking portion positioned in the inner space; and a second movable member coupled to the case and comprising a second wall facing the first wall, wherein the second wall has a particular opening formed therethrough at a position at which an edge of the particular opening contacts an outer peripheral surface of the projection during a mounting of the ink cartridge to the cartridge mounting portion, and wherein the second movable member is configured to move between a first position and a second position, and the second wall is positioned closer to the first wall when the second movable member is in the second position than when the second movable member is in the first position.

8. The ink supply system of claim 7, wherein the ink cartridge further comprises an air communication portion having a further opening formed therethrough, wherein the air communication portion comprises a valve element configured to move between a third position in which the valve element covers the further opening and a fourth position in which the valve element does not cover the further opening, and wherein when the ink cartridge is mounted to the cartridge mounting portion, the projection is configured to contact the valve element and to apply a force to move the valve element from the third position to the fourth position.

9. An ink supply system comprising:

a cartridge mounting portion comprising a projection protrusion; and an ink cartridge configured to be removably mounted to the cartridge mounting portion, wherein the ink cartridge comprises:

a case comprising:

an ink chamber configured to store ink therein; and a first wall facing an exterior of the case;

an ink supply portion positioned at the first wall, and configured to supply ink from an interior of the ink chamber to an exterior of the ink chamber; and a particular movable member coupled to the case, wherein the particular movable member comprises a second wall facing the first wall, wherein the second wall has a particular opening formed therethrough, at a position at which an edge of the particular opening contacts an outer peripheral surface of the projection during a mounting of the ink cartridge to the cartridge mounting portion, and wherein the particular movable member is configured to move between a first position and a second position, and the second wall is positioned closer to the first wall when the particular movable member is in the second position than when the particular movable member is in the first position.

10. The ink supply system of claim 9, wherein the ink cartridge further comprises an air communication portion having a further opening formed therethrough, wherein the air communication portion comprises a valve element configured to move between a third position in which the valve element covers the further opening and a fourth position in which the valve element does not cover the further opening, and wherein when the ink cartridge is mounted to the cartridge mounting portion, the projection is configured to contact the valve element and to apply a force to move the valve element from the third position to the fourth position.

* * * * *